US009234649B2

(12) United States Patent
Boyer et al.

(10) Patent No.: US 9,234,649 B2
(45) Date of Patent: Jan. 12, 2016

(54) LUMINAIRES AND LIGHTING STRUCTURES

(75) Inventors: John D. Boyer, Lebanon, OH (US); James G. Vanden Eynden, Indian Springs, OH (US); Larry Akers, Clarksville, OH (US)

(73) Assignee: LSI Industries, Inc., Cincinnati, OH (US)

( * ) Notice: Subject to any disclaimer, the term of this patent is extended or adjusted under 35 U.S.C. 154(b) by 510 days.

(21) Appl. No.: 13/286,400

(22) Filed: Nov. 1, 2011

(65) Prior Publication Data

US 2013/0107518 A1 May 2, 2013

(51) Int. Cl.
*F21V 15/01* (2006.01)
*F21V 7/09* (2006.01)
(Continued)

(52) U.S. Cl.
CPC . *F21V 7/09* (2013.01); *F21S 2/005* (2013.01); *F21V 7/005* (2013.01); *F21V 15/01* (2013.01); *F21V 17/002* (2013.01); *F21V 19/04* (2013.01); *F21V 29/004* (2013.01); *F21V 29/507* (2013.01); *F21V 29/75* (2013.01); *F21V 29/763* (2013.01); *F21V 31/005* (2013.01); *F21W 2131/103* (2013.01); *F21W 2131/105* (2013.01); *F21W 2131/107* (2013.01); *F21Y 2101/02* (2013.01); *F21Y 2103/003* (2013.01)

(58) Field of Classification Search
CPC ..... F21S 2/005; F21V 17/002; F21V 31/005; F21V 29/004; F21V 7/09; F21V 29/507; F21V 29/763; F21V 7/005; F21V 15/01; F21V 19/04; F21V 29/75; F21W 2131/10; F21W 2131/107; F21W 2131/105; F21Y 2103/003; F21Y 2101/02
See application file for complete search history.

(56) References Cited

U.S. PATENT DOCUMENTS 1,166,685 A 1/1916 Holland et al.
1,767,590 A 6/1930 Jaquith
(Continued)

FOREIGN PATENT DOCUMENTS

CN 201251150 6/2009
CN 201521928 7/2010
(Continued)

OTHER PUBLICATIONS

"Relume Low Bay Led Fixtures"; Relume Technologies, Inc., www.relume.com, (2011).
(Continued)

*Primary Examiner* — Anh Mai
*Assistant Examiner* — Fatima Farokhrooz
(74) *Attorney, Agent, or Firm* — McDermott Will & Emery LLP

(57) ABSTRACT

A luminaire is disclosed comprising one or more side members having one or more light modules associated therewith and defining a recess. The light module having one or more light sources, one or more light directing members, and a lens enclosing the light sources and directing members in the module. The light directing members redirecting light emitted from at least one of the one or more light sources to be perpendicular to the lens. One or more of the light directing members can be a reflector or an optic lens. The light modules can be configured to cast different light distributions to combine to form the desired light distribution. The light modules can be designed or exchanged to create any desired light distribution from the same side members. The light module can comprise a tray such that the lens is sealed to the tray keeping moisture from entering the module.

22 Claims, 25 Drawing Sheets

(51) Int. Cl.

| | |
|---|---|
| ***F21V 29/00*** | (2015.01) |
| ***F21V 31/00*** | (2006.01) |
| ***F21S 2/00*** | (2006.01) |
| ***F21V 7/00*** | (2006.01) |
| ***F21V 17/00*** | (2006.01) |
| ***F21V 19/04*** | (2006.01) |
| ***F21V 29/507*** | (2015.01) |
| ***F21V 29/75*** | (2015.01) |
| ***F21V 29/76*** | (2015.01) |
| *F21W 131/103* | (2006.01) |
| *F21W 131/105* | (2006.01) |
| *F21W 131/107* | (2006.01) |
| *F21Y 101/02* | (2006.01) |
| *F21Y 103/00* | (2006.01) |

(56) References Cited

U.S. PATENT DOCUMENTS

D98,924 S 3/1936 Fassin
2,128,470 A 8/1938 Phillips
2,316,546 A 4/1943 Anderson et al.
2,741,694 A 4/1956 Vilhelm et al.
D186,718 S 11/1959 Summers
3,033,979 A 5/1962 Cahill
D195,583 S 7/1963 Phillips
D200,118 S 1/1965 Van Steenhoven
D208,491 S 9/1967 Brooks
D219,546 S 12/1970 Kaiser et al.
3,544,787 A 12/1970 Audeval
D239,861 S 5/1976 Van Steenhoven
4,268,897 A 5/1981 Schierwagen et al.
4,425,603 A 1/1984 Courson
4,617,612 A 10/1986 Pritchett
4,729,076 A 3/1988 Masami et al.
4,780,800 A 10/1988 Mullins
5,008,791 A 4/1991 Caferro
5,561,346 A 10/1996 Byrne
5,613,766 A 3/1997 Raouf
5,642,933 A * 7/1997 Hitora ..... 362/243
5,647,152 A 7/1997 Miura
8,459,824 B1 1/1998 Bingham
5,730,521 A 3/1998 Spink et al.
5,806,957 A * 9/1998 Prior et al. ..... 362/459
5,806,972 A 9/1998 Kaiser et al.
5,857,765 A 1/1999 Deron
5,857,767 A 1/1999 Hochstein
D437,958 S 2/2001 Doron et al.
D439,695 S 3/2001 Compton et al.
D442,313 S 5/2001 Wojtkowiak et al.
6,250,774 B1 6/2001 Begemann et al.
6,517,218 B2 2/2003 Hochstein
6,692,137 B2 2/2004 Blanchard
6,874,911 B2 4/2005 Yoneda
7,021,799 B2 4/2006 Mizuyoshi
7,217,009 B2 5/2007 Klose
7,244,058 B2 7/2007 DiPenti et al.
7,267,459 B2 9/2007 Matheson
7,285,903 B2 10/2007 Cull et al.
D556,935 S 12/2007 Quioque et al.
7,311,431 B2 12/2007 Chew et al.
7,338,186 B1 3/2008 Wu et al.
D573,741 S 7/2008 Lou
7,461,952 B2 12/2008 Trenchardl et al.
7,588,355 B1 9/2009 Liu et al.
D603,077 S 10/2009 Kinnune et al.
7,611,264 B1 11/2009 Chang et al.
7,635,204 B2 12/2009 Yu
D607,593 S 1/2010 Yoo
D609,384 S 2/2010 Gray et al.
7,665,866 B2 2/2010 Mayer et al.
D612,090 S 3/2010 Yu
D617,033 S 6/2010 Gaskins
7,762,690 B2 7/2010 Li et al.
D622,433 S 8/2010 Waters
D627,093 S 11/2010 Shiau et al.
7,837,362 B2 11/2010 Zhang
7,841,738 B2 11/2010 Engel
7,887,216 B2 2/2011 Patrick
7,914,183 B2 3/2011 Yang et al.
D636,920 S 4/2011 Boissevain
7,922,354 B2 4/2011 Everhart
7,926,985 B2 4/2011 Teng et al.
7,952,262 B2 5/2011 Wilcox et al.
7,959,327 B2 6/2011 Lai et al.
7,967,462 B2 6/2011 Ogiro et al.
D641,908 S 7/2011 McKee
8,021,024 B2 9/2011 Huang
D647,662 S 10/2011 Verelst et al.
8,038,314 B2 * 10/2011 Ladewig ..... 362/217.12
8,038,321 B1 10/2011 Franck et al.
D650,112 S 12/2011 Bryant
8,075,152 B2 12/2011 Chen et al.
8,075,164 B2 12/2011 Xiao et al.
8,087,807 B2 1/2012 Liu et al.
8,106,568 B2 1/2012 Kao et al.
8,167,466 B2 5/2012 Liu
8,210,724 B2 7/2012 Ying
8,220,961 B2 7/2012 Belknap et al.
8,246,219 B2 8/2012 Teng et al.
8,251,546 B2 8/2012 Chen et al.
8,256,927 B2 9/2012 Hu et al.
8,425,071 B2 4/2013 Ruud et al.
2002/0001193 A1 1/2002 Osawa et al.
2004/0207315 A1 10/2004 Robbie et al.
2005/0157500 A1 7/2005 Chen et al.
2005/0259082 A1 11/2005 Potsch
2005/0280683 A1 * 12/2005 Custer ..... 347/102
2006/0012286 A1 1/2006 Cull et al.
2006/0209541 A1 9/2006 Peck
2007/0002565 A1 * 1/2007 Han et al. ..... 362/240
2007/0002572 A1 1/2007 Ewig et al.
2007/0002577 A1 1/2007 Tsukamoto
2007/0081339 A1 4/2007 Chung et al.
2007/0247851 A1 10/2007 Villard
2007/0285920 A1 12/2007 Seabrook
2008/0278943 A1 11/2008 Van Der Poel
2008/0278957 A1 11/2008 Pickard et al.
2009/0185379 A1 7/2009 Chen
2009/0201668 A1 8/2009 Ogiro et al.
2009/0213588 A1 8/2009 Manes
2009/0262543 A1 10/2009 Ho
2009/0303715 A1 12/2009 Takasago et al.
2009/0323330 A1 12/2009 Gordin et al.
2010/0019689 A1 * 1/2010 Shan ..... 315/294
2010/0027254 A1 2/2010 Nakayama
2010/0027256 A1 * 2/2010 Kinoshita ..... 362/235
2010/0073925 A1 3/2010 Vissenberg et al.
2010/0103679 A1 4/2010 Lee
2010/0110679 A1 5/2010 Teng et al.
2010/0118496 A1 5/2010 Lo
2010/0118531 A1 5/2010 Montagne
2010/0135006 A1 6/2010 Huang
2010/0142201 A1 6/2010 Venturini
2010/0157610 A1 6/2010 Xiao et al.
2010/0165620 A1 7/2010 Marson
2010/0165641 A1 7/2010 Cheng
2010/0172152 A1 7/2010 Boonekamp
2010/0188847 A1 7/2010 Chen
2010/0202140 A1 * 8/2010 Rooymans et al. ..... 362/231
2010/0254148 A1 10/2010 Huang et al.
2010/0259927 A1 10/2010 Chien
2010/0277916 A1 11/2010 Kira
2010/0309662 A1 12/2010 Zheng
2011/0013397 A1 * 1/2011 Catone et al. ..... 362/244
2011/0026249 A1 * 2/2011 Wylde et al. ..... 362/240
2011/0038154 A1 2/2011 Chakravarty et al.
2011/0058358 A1 3/2011 Soo et al.
2011/0096544 A1 * 4/2011 Nakamura ..... 362/235
2011/0110082 A1 5/2011 Jong
2011/0122616 A1 * 5/2011 Hochstein ..... 362/235
2011/0122618 A1 * 5/2011 Gantenbrink ..... 362/241
2011/0149566 A1 6/2011 Lin et al.
2011/0170288 A1 * 7/2011 Kim ..... 362/235

(56) References Cited

U.S. PATENT DOCUMENTS

| | | | | |
|---|---|---|---|---|
| 2011/0188233 | A1 | 8/2011 | Josefowicz et al. | |
| 2011/0194281 | A1* | 8/2011 | Josefowicz et al. | 362/235 |
| 2011/0205738 | A1 | 8/2011 | Peifer et al. | |
| 2011/0211335 | A1* | 9/2011 | Ko | 362/97.1 |
| 2011/0280016 | A1 | 11/2011 | Content et al. | |
| 2011/0304270 | A1 | 12/2011 | Scarpelli | |
| 2011/0317420 | A1 | 12/2011 | Jeon et al. | |
| 2011/0317425 | A1 | 12/2011 | Jeon et al. | |
| 2012/0002411 | A1 | 1/2012 | Ladewig | |
| 2012/0106148 | A1 | 5/2012 | De Silva | |
| 2012/0147603 | A1 | 6/2012 | Hochstein | |
| 2012/0182713 | A1 | 7/2012 | Bretschneider | |
| 2013/0088871 | A1 | 4/2013 | Yun et al. | |
| 2013/0100662 | A1 | 4/2013 | Lin | |
| 2013/0271959 | A1 | 10/2013 | Woodgate et al. | |

FOREIGN PATENT DOCUMENTS

| | | | |
|---|---|---|---|
| CN | 101813249 | | 8/2010 |
| CN | 201606684 | | 10/2010 |
| CN | 202109331 | | 1/2012 |
| CN | 202118689 | | 1/2012 |
| CN | 202203700 | | 4/2012 |
| CN | 202419384 | | 9/2012 |
| CN | 202469648 | | 10/2012 |
| DE | 202009014873 | | 5/2010 |
| EP | 1371901 | | 12/2003 |
| GB | 1126868 | | 9/1968 |
| JP | 7326217 | A | 12/1995 |
| JP | 2002-184209 | | 6/2002 |
| JP | 2003-347595 | | 5/2003 |
| JP | 2004-014367 | | 1/2004 |
| JP | 2005-150036 | | 9/2005 |
| JP | 2007-306309 | | 11/2007 |
| WO | 2004053817 | | 6/2004 |
| WO | 2010006665 | | 1/2010 |
| WO | 2010028505 | A1 | 3/2010 |

OTHER PUBLICATIONS

Invitation to Pay Additional Fees and Annex to Form PCT/ISA/206: Partial International Search dated Jan. 30, 2013 from PCT Application No. PCT/US2012/062552.

Response dated Feb. 13, 2014 to Office action dated Jan. 6, 2014 from corresponding U.S. Appl. No. 13/363,896.

Response dated Aug. 4, 2014 to the Written Opinion dated Jul. 31, 2013 from Corresponding PCT Application No. PCT/US2012/062552.

Office Action dated Jan. 6, 2014 from Corresponding U.S. Appl. No. 13/363,896.

Examination Report dated Feb. 4, 2014 from Corresponding Australian Patent Application No. 2013202261.

International Preliminary Report on Patentability dated May 6, 2014 from Corresponding PCT/US2012/062552.

International Search Report and the Written Opinion dated Jul. 31, 2013 from Corresponding PCT Application No. PCT/US2012/062552.

Final Office Action dated Jun. 12, 2015 from corresponding U.S. Appl. No. 13/363,896.

Final Office Action dated Jun. 24, 2015 from corresponding U.S. Appl. No. 13/621,510.

* cited by examiner

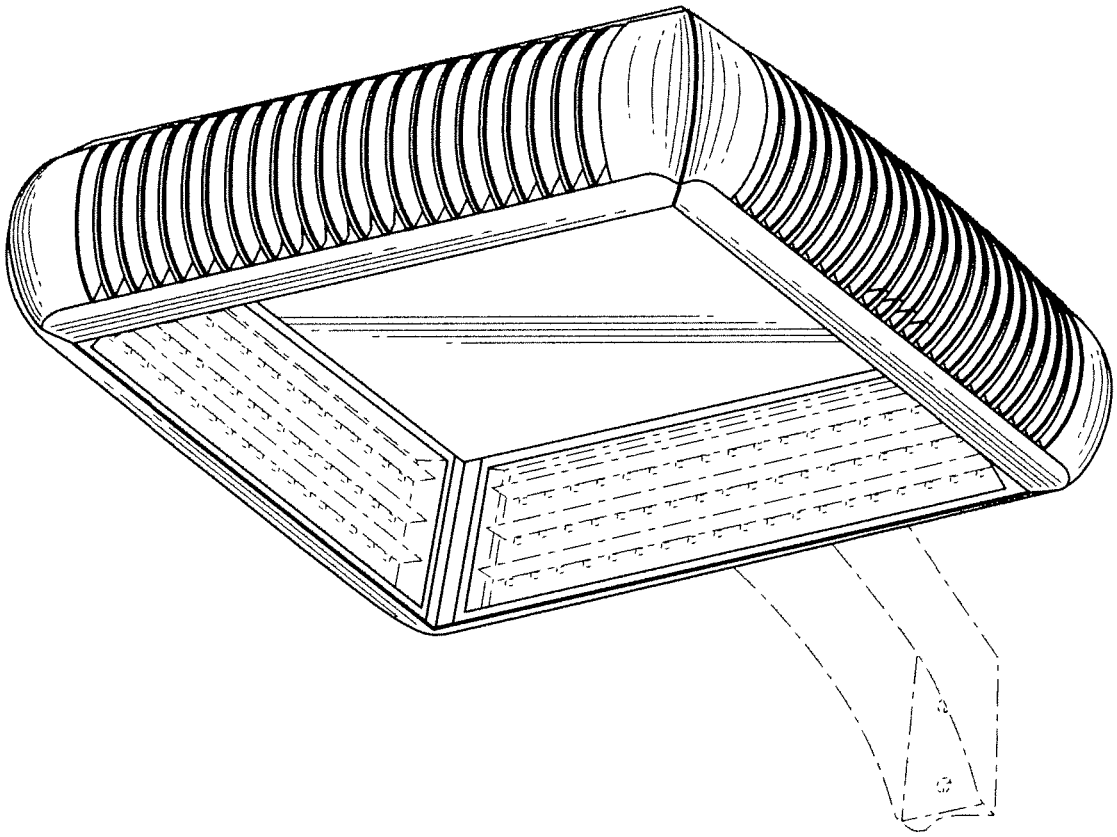
FIG. 13 DES

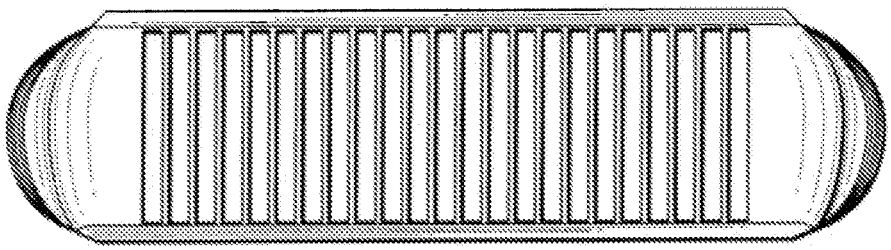
FIG. 14 DES
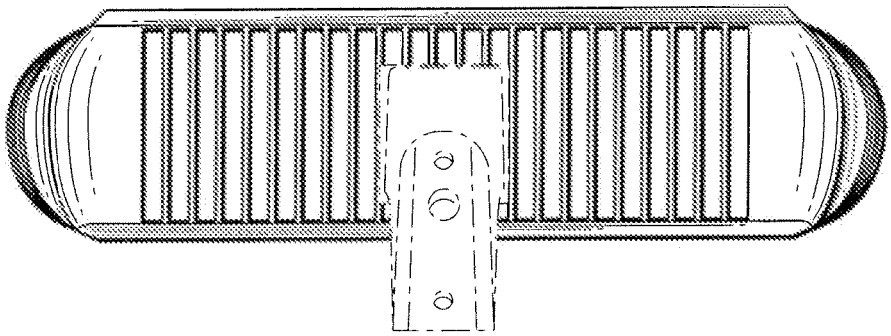
FIG. 15 DES

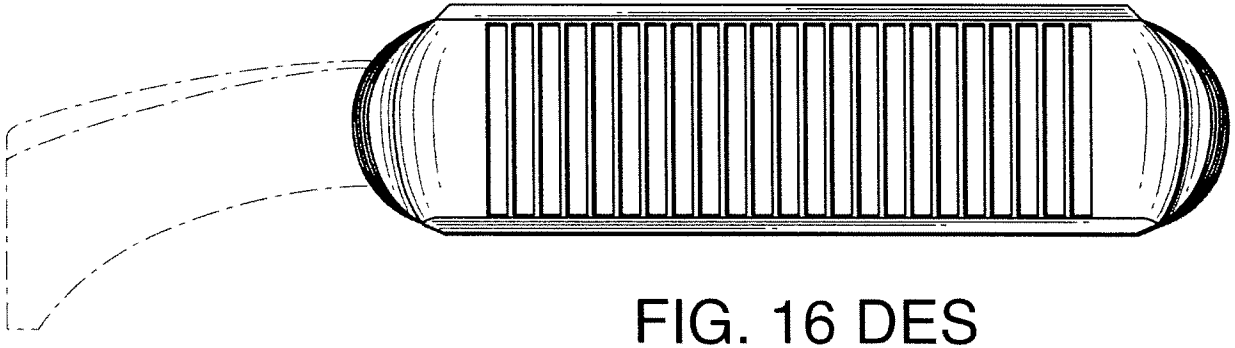
FIG. 16 DES
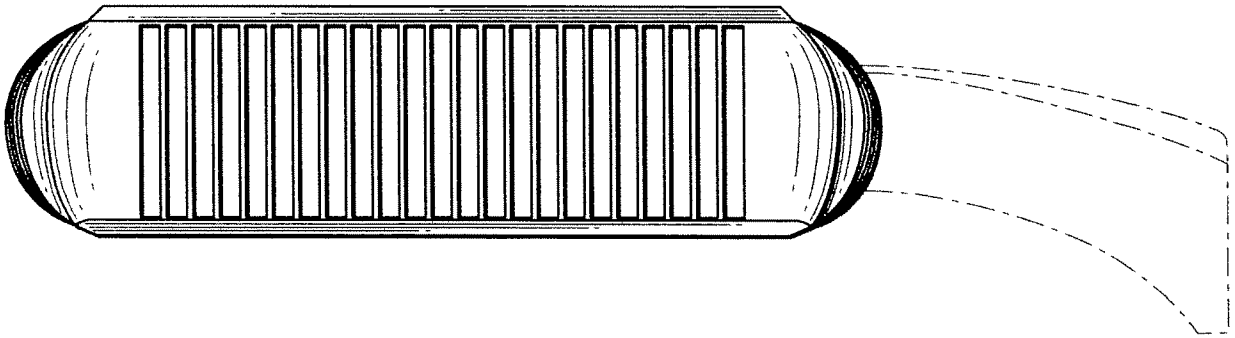
FIG. 17 DES

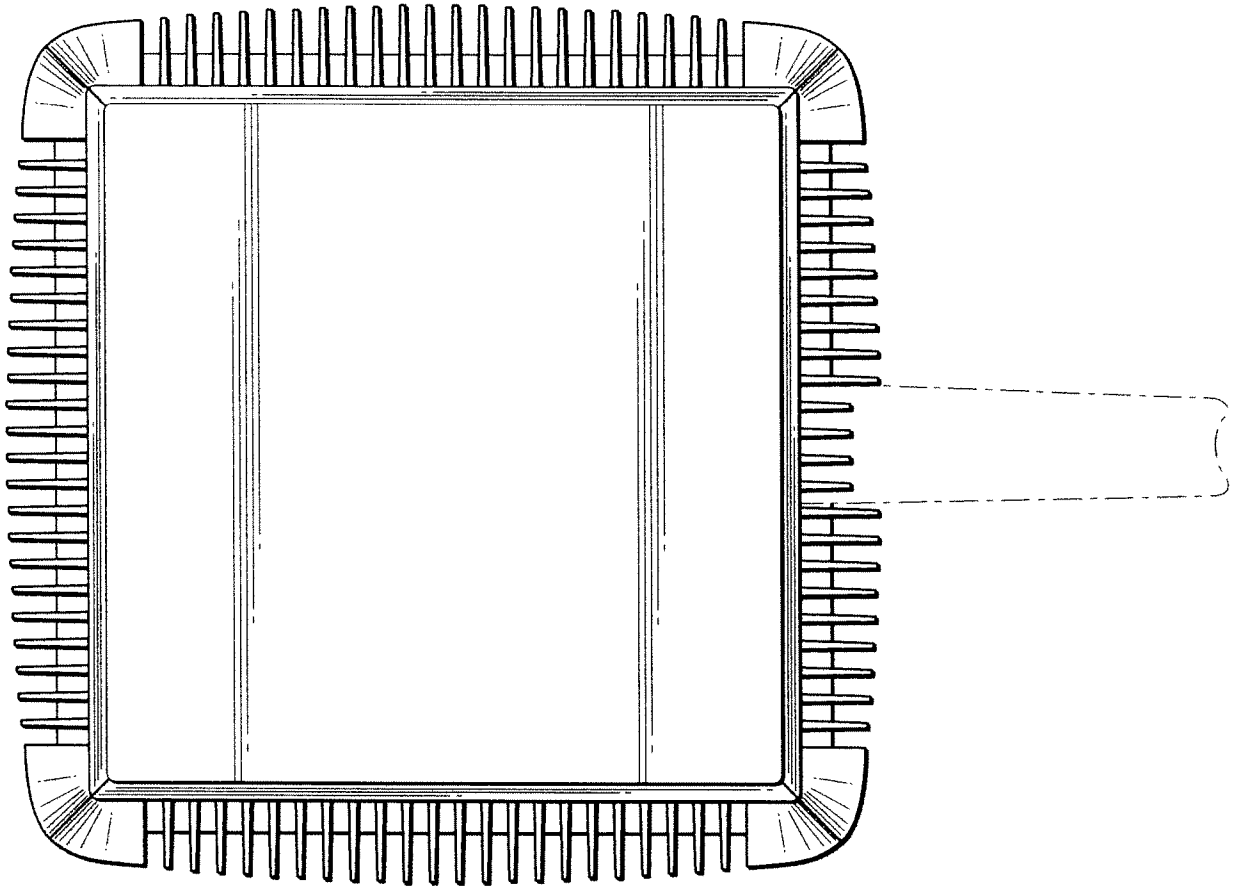
FIG. 18 DES

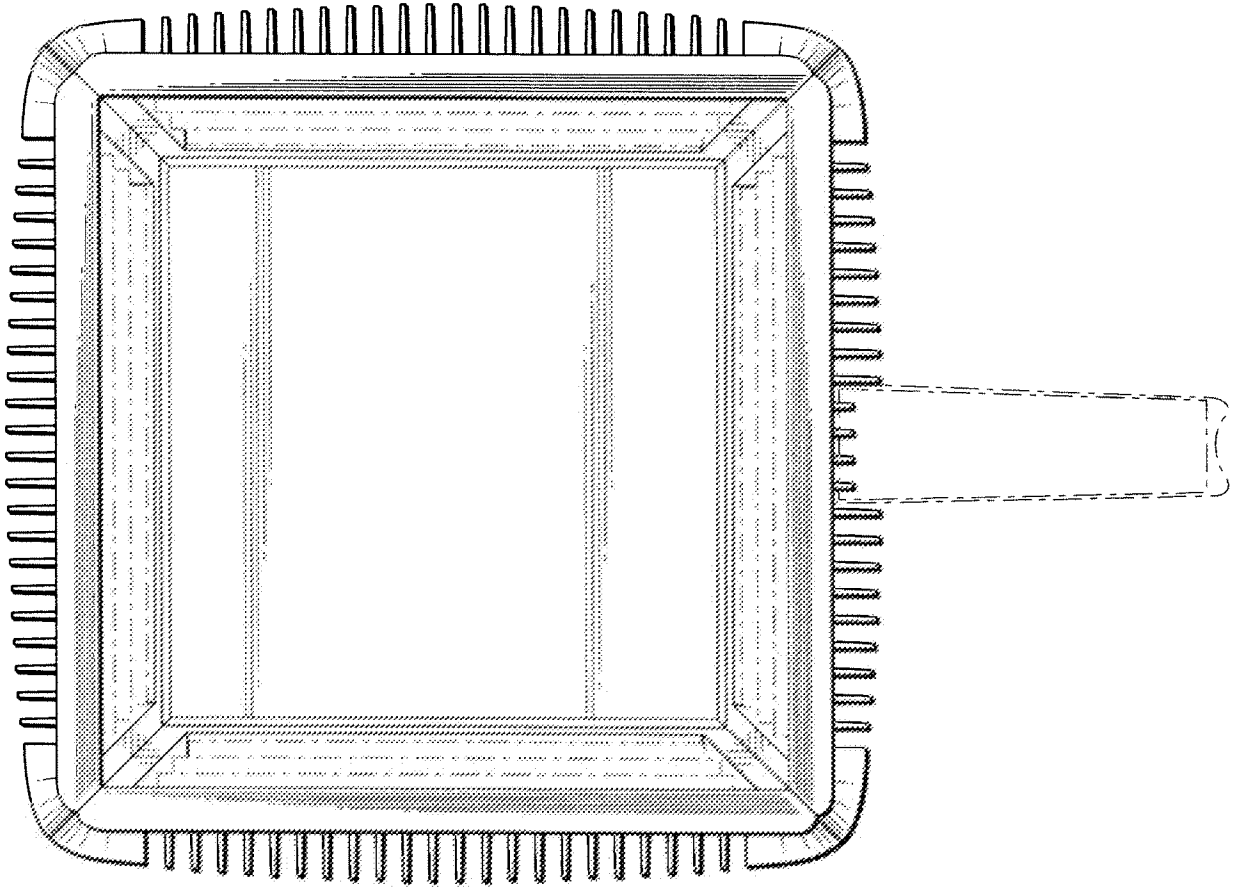
FIG. 19 DES

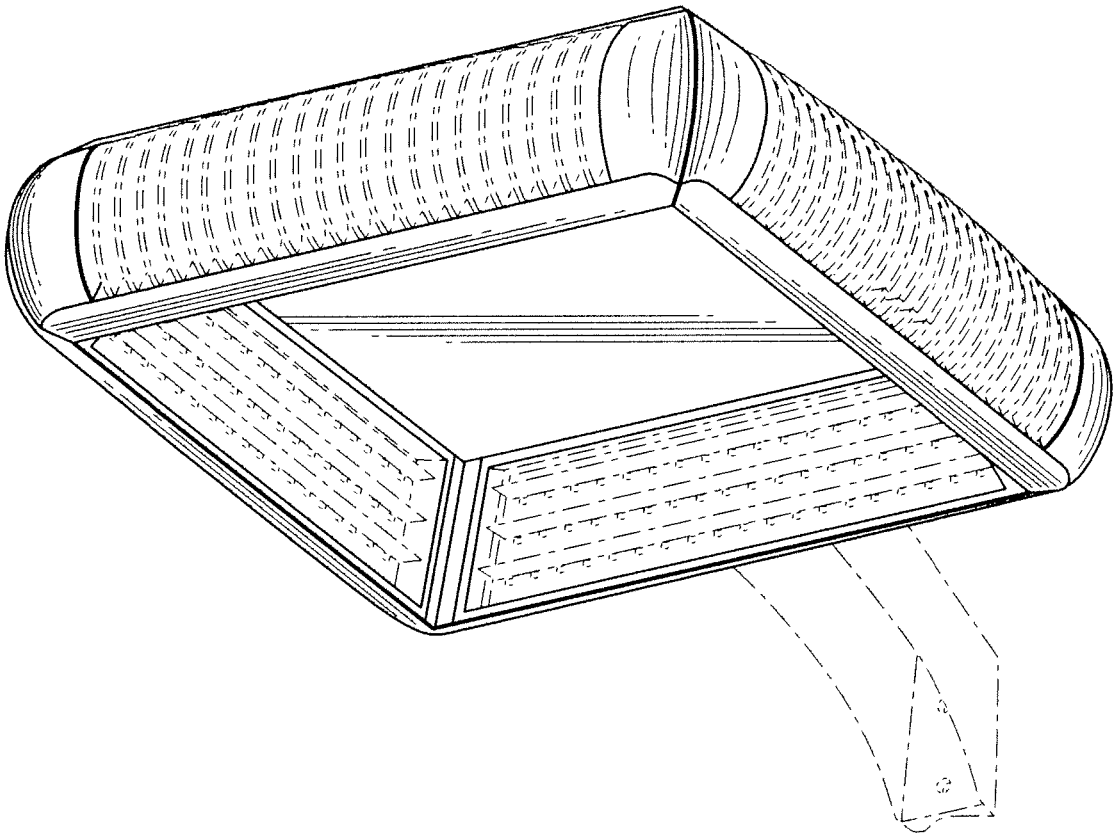
FIG. 20 DES

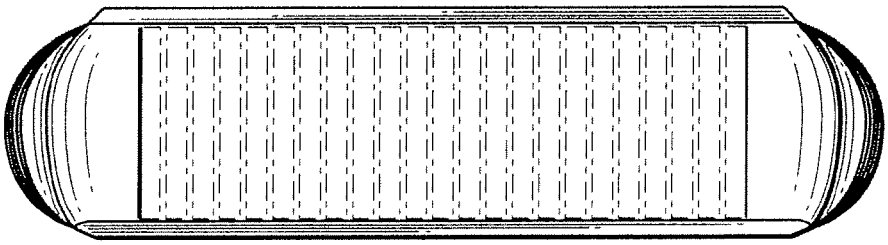
FIG. 21 DES
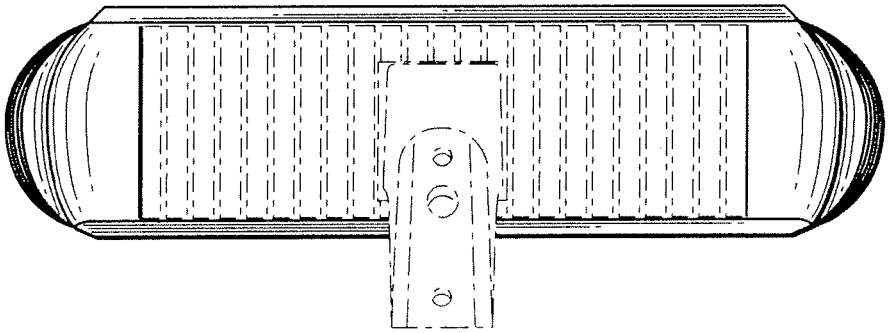
FIG. 22 DES

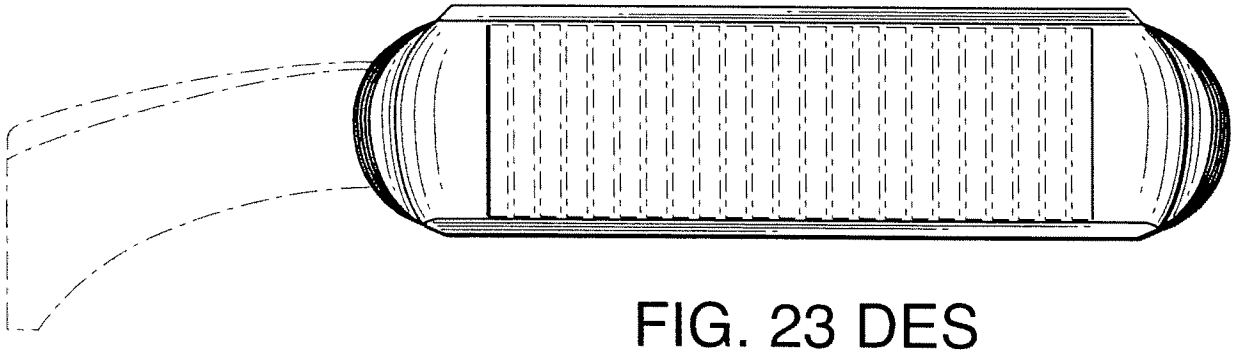
FIG. 23 DES
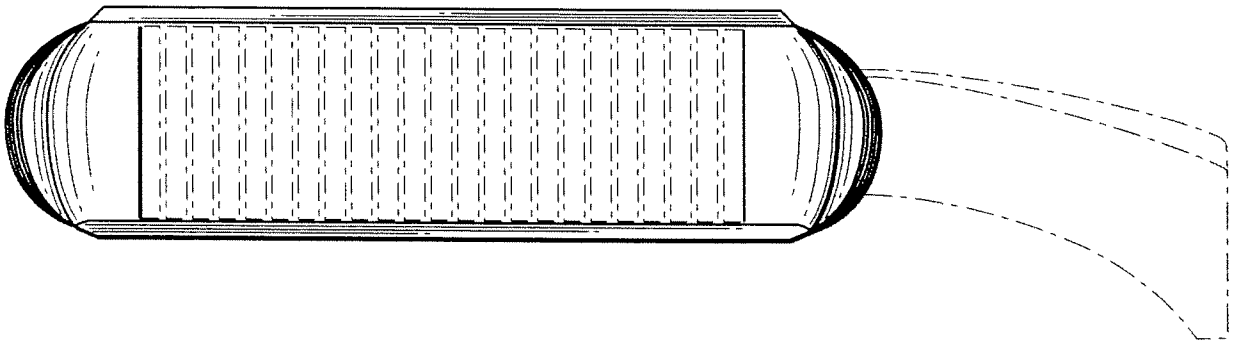
FIG. 24 DES

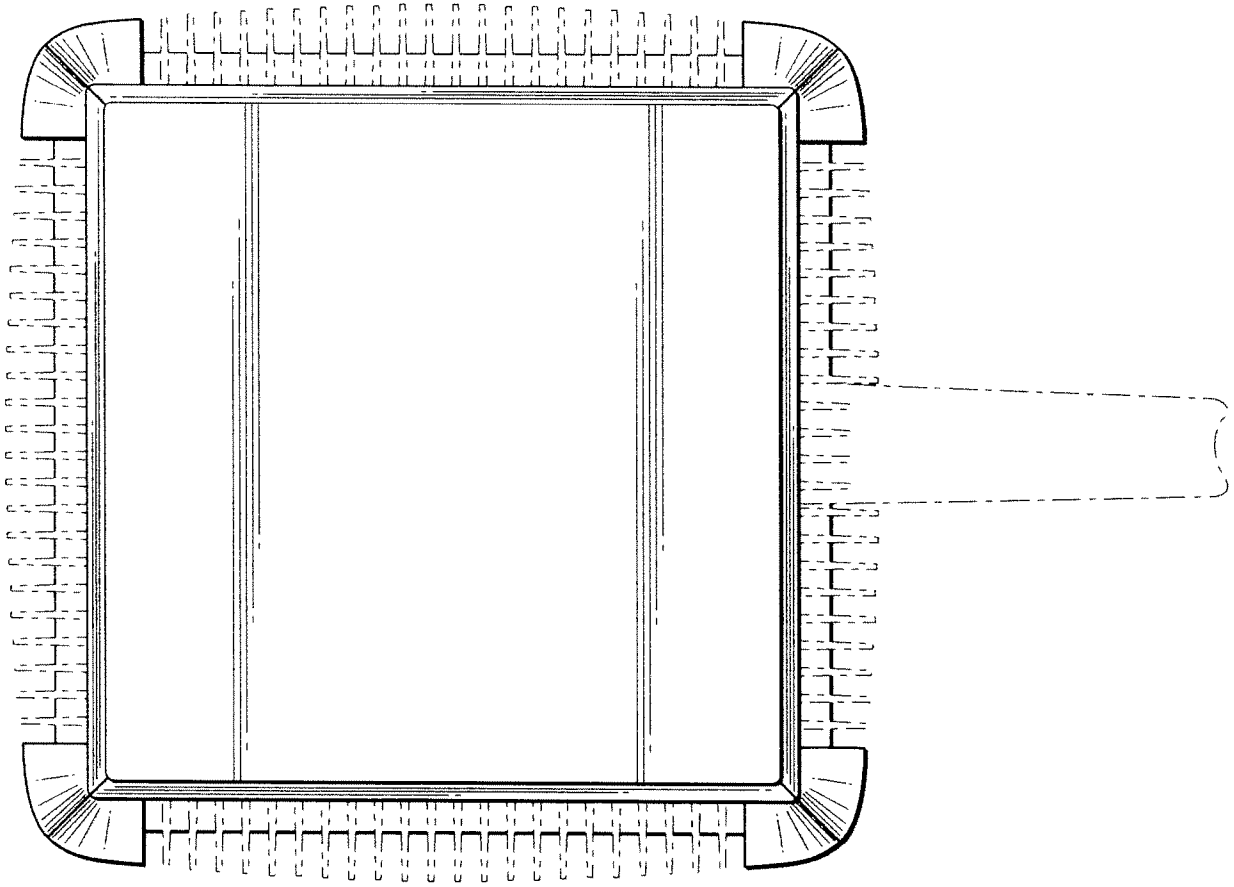
FIG. 25 DES

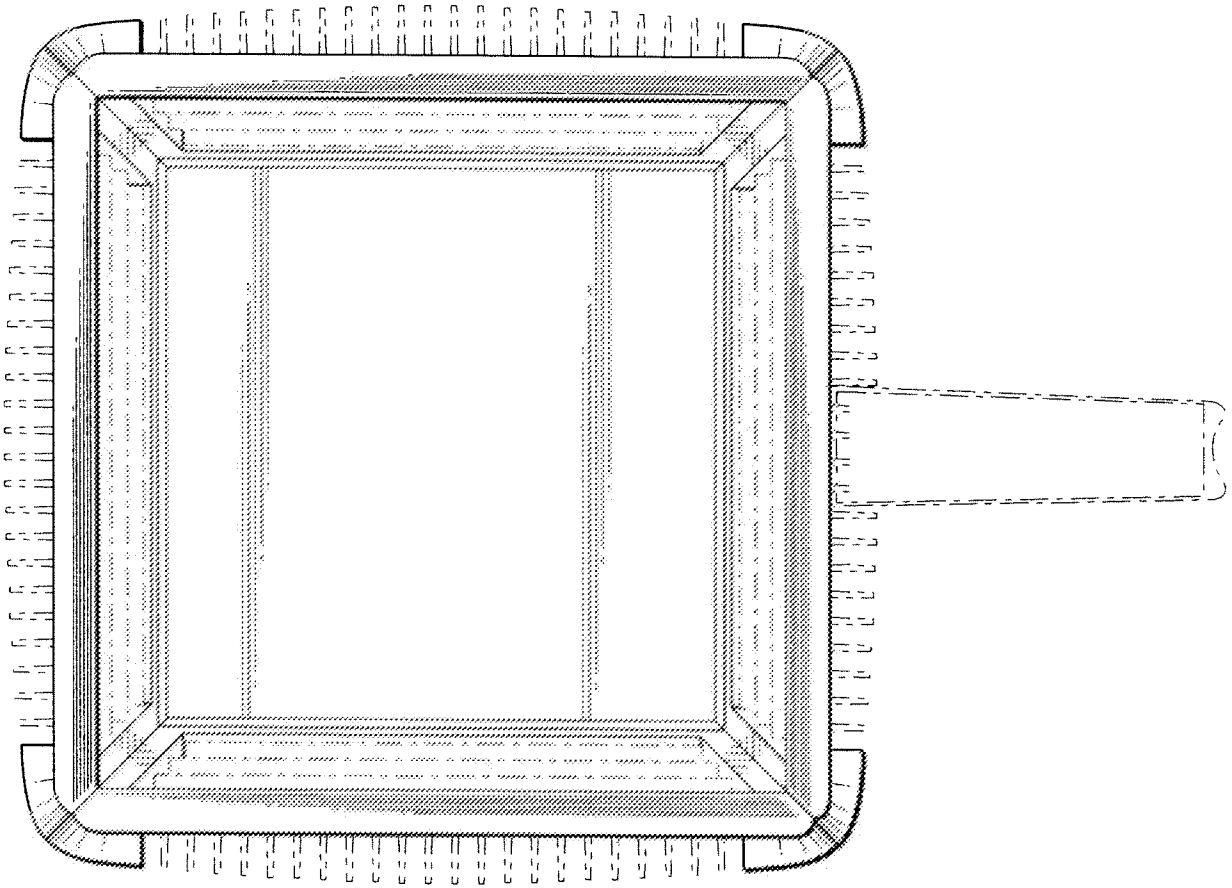
FIG. 26 DES

LUMINAIRES AND LIGHTING STRUCTURES

FIELD OF THE DISCLOSURE

The present disclosure is directed generally to a luminaire for casting light to enlighten area. More particularly the present disclosure is directed to a luminaire constructed to efficiently direct light to areas desired to be lighted, while avoiding areas not desired to be lighted. The present disclosure also relates to a luminaire for efficiently managing heat generated by light sources. The present disclosure further relates to a versatile luminaire comprising one or more lighting modules and capable of producing different light distributions dependent upon the number or type of light modules provided to the luminaire. The present disclosure additionally relates to sealed lighting modules facilitating the previously mentioned versatility of a luminaire as well as providing simple replacement of broken, worn or outdated lighting modules.

BACKGROUND OF THE DISCLOSURE

There is a need for a luminaire of the type described herein.

SUMMARY OF THE DISCLOSURE

In one aspect of the disclosure, a luminaire comprises one or more side members each defining an upper edge, a lower edge, a face and an opposing outer side, the faces of the side members defining a recess and face into the recess; a recess defined in the face of at least one side member; a light module in the recess in the face of the at least one side member, the light module comprising: one or more light sources; one or more light directing members; a lens enclosing the light sources and directing members in the module; the light directing members redirecting light emitted from at least one of the one or more light sources to be perpendicular to the lens; the light module lens facing the recess; and the luminaire having no lens extending across the lower edges of the side members. In one exemplary embodiment, at least one light source is an LED. In one exemplary embodiment, one or more of the light directing members is a reflector. In one exemplary embodiment, one or more of the light directing members is an optic lens. In one exemplary embodiment, the light modules direct light toward and through the recess. In one exemplary embodiment, at least one of the side members comprises heat dissipation fins. In one exemplary embodiment, the luminaire has a ceiling extending between an upper edge of each of the side members. In one exemplary embodiment, the luminaire has four side members. In one exemplary embodiment, at least one of the side members comprises no light module. In one exemplary embodiment, the luminaire comprises at least two light modules which are configured to cast different light distributions different from one another. In one exemplary embodiment, the light module comprising a tray and the lens is sealed to the tray keeping moisture from entering the module. In one exemplary embodiment, at least one of the one or more side members comprises a plurality of light modules.

In another aspect of the disclosure, a luminaire comprises four side members, each side member having an upper edge, a lower edge and an inner face and the four inner faces together defining a recess closed on one end by a ceiling; a recess defined in the inner face of at least one of the side members; a light module in the recess defined in the inner face of the at least one of the side members, the light module comprising: a tray; one or more light sources attached to the tray; one or more light reflectors or optic lenses associated with one or more of the light sources; a lens enclosing and sealing the light sources and the one or more light reflectors or optic lenses in the module and redirecting light emitted from at least one of the one or more light sources to be perpendicular to the lens; and the four side member lower edges defining a plane forming an angle with each light module lens. In one exemplary embodiment, at least one light source is an LED. In one exemplary embodiment, the light module is in surface contact with the side member to conduct heat away from the light module. In one exemplary embodiment, at least one of the side members comprises heat dissipation fins. In one exemplary embodiment, the recess defined by the four side members is closed on one end by the ceiling extending between an upper edge of each of the side members. In one exemplary embodiment, the luminaire has no lens extending across a lower edge of each of the side members. In one exemplary embodiment, at least one of the side members comprises no light module. In one exemplary embodiment, at least two of the light modules are configured to cast different light distributions. In one exemplary embodiment, the light module comprises a seal between the tray and the lens keeping moisture from entering the module. In one exemplary embodiment, at least one of the light modules is removable from an associated side member.

In yet another aspect of the disclosure, a luminaire comprises a first side member, a second side member, a third side member and a fourth side member, each side member having an upper edge, a lower edge and an inner face and the four inner faces together defining a recess closed on one end by a ceiling; a first light module associated with the first side member, a second light module associated with the second side member and a third light module associated with the third side member, each of the light modules comprising: a tray; one or more light sources attached to the tray; one or more light reflectors or optic lenses associated with one or more of the light sources; and a lens enclosing and sealing the light sources and the one or more light reflectors or optic lenses in the module; wherein no light module is associated with the fourth side member. In one exemplary embodiment, the luminaire produces a light distribution approximating an IESNA Type IV light distribution.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings:

FIGS. 13DES through 19DES depict a first embodiment of one ornamental design of the present disclosure, including perspective, front side, rear side, left side, right side, top and bottom views; and FIGS. 20DES through 26DES depict a second embodiment of the ornamental design of the present disclosure, including perspective, front side, rear side, left side, right side, top and bottom views.

Figure 1:
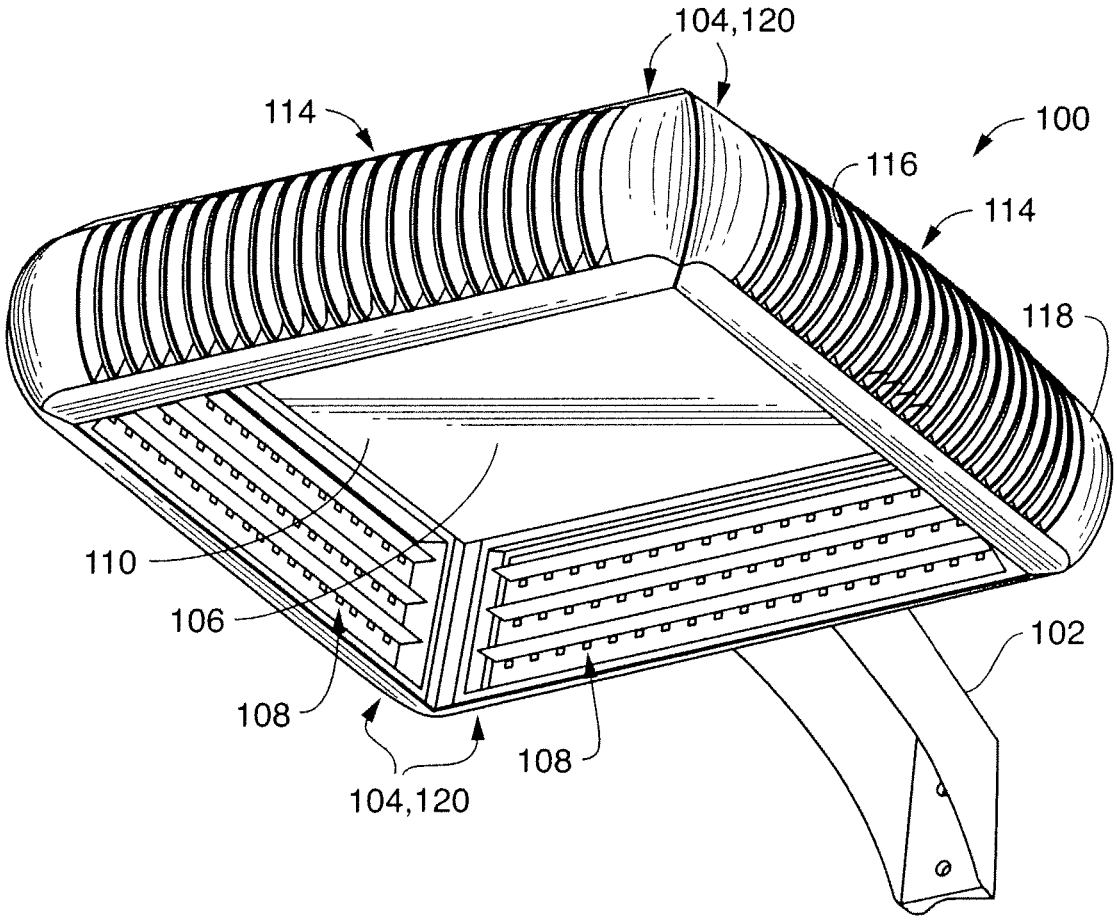
FIG. 1 depicts a perspective view of a luminaire in accordance with the present disclosure, ornamental features of which are shown in FIGS. 1DES through 14 DES.
Figure 2:
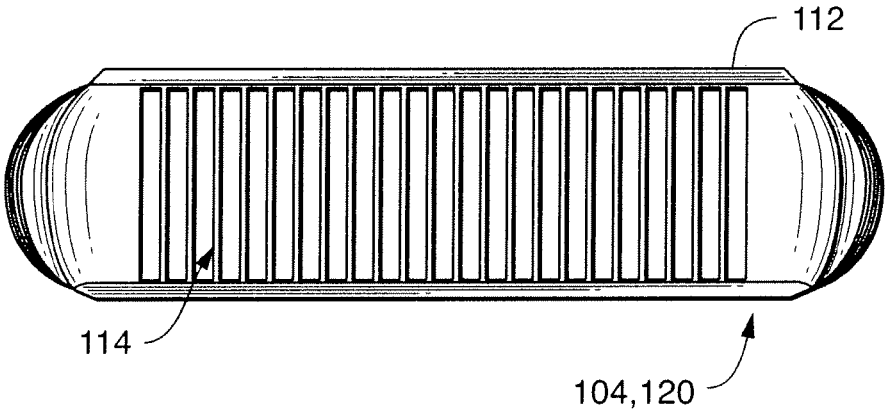
FIG. 2 depicts a side view of the luminaire of FIG. 1.
Figure 3:
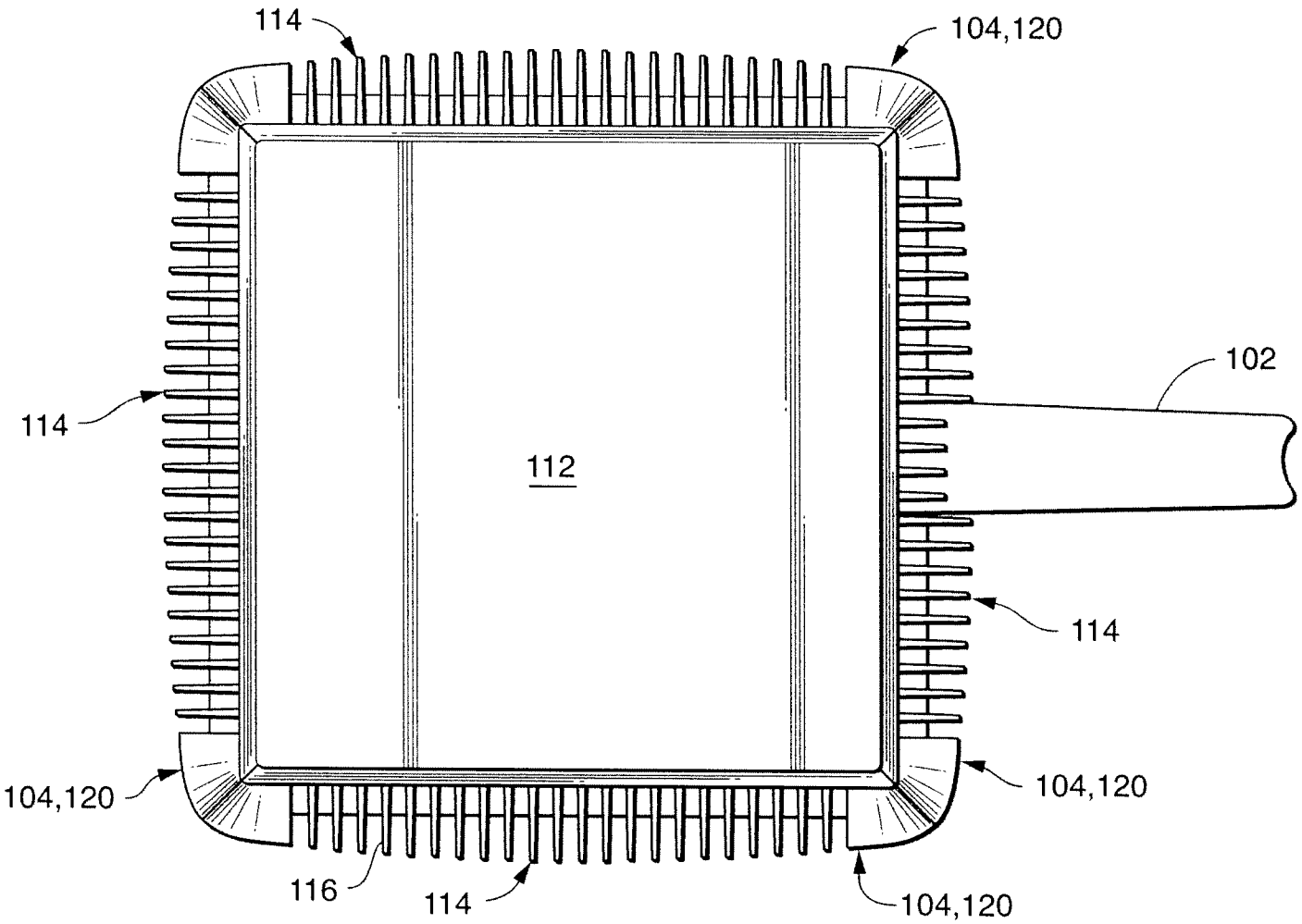
FIG. 3 depicts a top view of the luminaire of FIG. 1.
Figure 4:
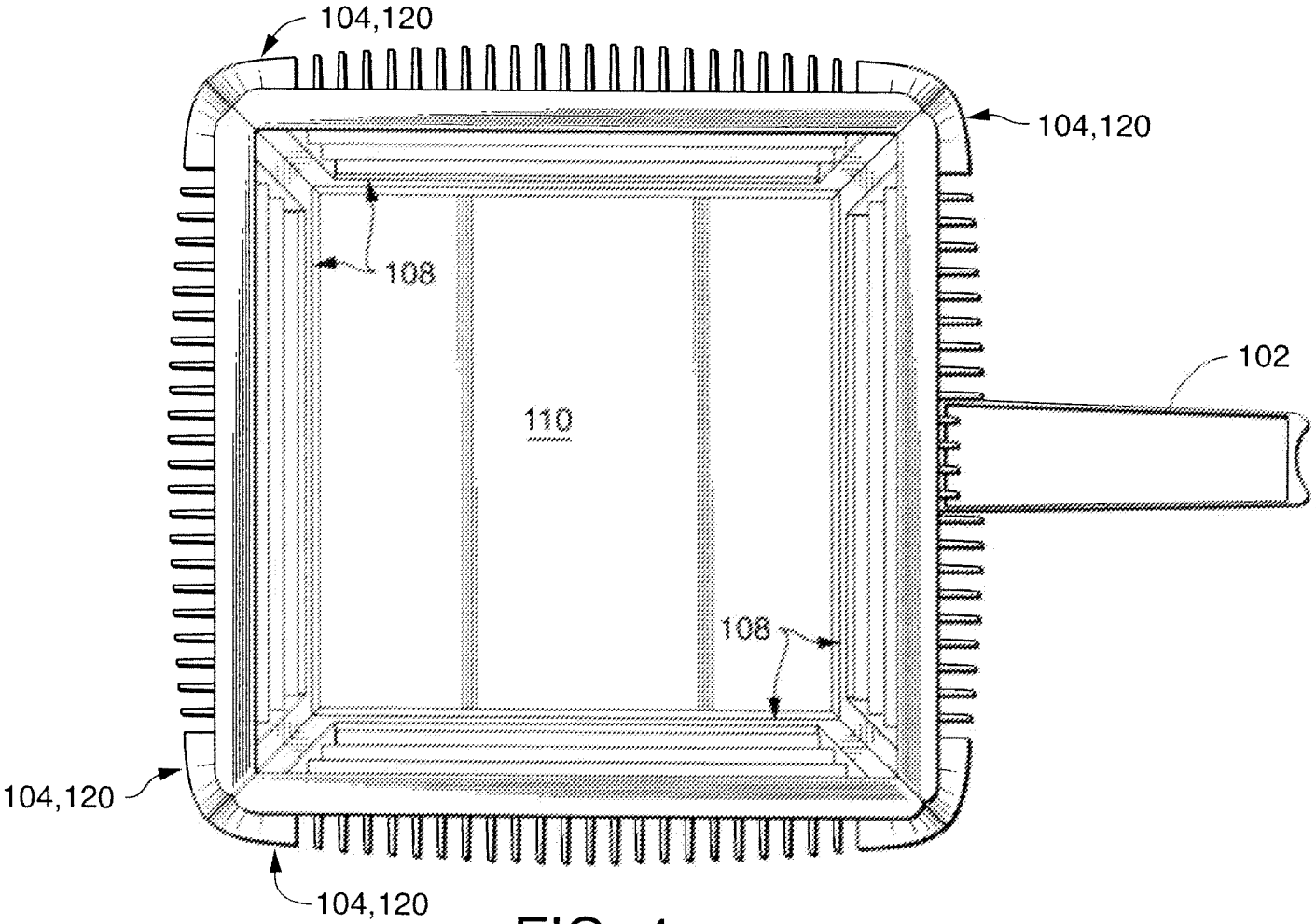
FIG. 4 depicts a bottom view of the luminaire of FIG. 1.

The embodiments depicted in the drawing are merely illustrative. Variations of the embodiments shown in the drawings, including embodiments described herein, but not depicted in the drawings, may be envisioned and practiced within the scope of the present disclosure.

DETAILED DESCRIPTION

Aspects and embodiments of the present disclosure provide luminaries and elements thereof. Luminaries according to the present disclosure can be used for new installations or to replace existing luminaries or elements thereof. Use of such luminaire and lighting elements can afford reduced energy and maintenance as well as reduced installation time and costs when compared to existing techniques. The versatility of the luminaire and elements of the present disclosure also afford efficiencies to manufacturers, installers and end-users of such luminaire through lower manufacturing and inventory costs as well as the ability of the end-user to upgrade, adapt or fix the luminaire in the field.

While the preferred embodiment uses light emitting diodes ("LEDs") as light sources, other light sources may be used in addition to LEDs or instead of LEDs within the scope of the present disclosure. By way of example only, other light sources such as plasma light sources may be used. Further, the term "LEDs" is intended to refer to all types of light emitting diodes including organic light emitting diodes or "OLEDs".

While the luminaire depicted in the Figures is generally applicable to any application that would benefit from indoor or outdoor area lighting, it is well-suited, in one example, for application to parking lots and garages. In other embodiments the teachings of this disclosure are applicable to, for example, street lighting.

FIG. 1 depicts a perspective view of a luminaire 100, in accordance with the present disclosure. A mounting bracket 102 extends from luminaire 100 for mounting to, for example, a wall of a building. Other applications and corresponding mounting are contemplated, such as atop of pole, where one or more luminaries 100 may be mounted. The luminaire 100 could also be hung from a ceiling facing downward (as depicted) or facing upward to cast light toward the ceiling.

The luminaire 100 depicted in FIG. 1 is comprised of four sides 104 arranged in a rectangular (depicted as square) configuration creating an internal recess 106 defined by the inside faces of the four sides 104. The inside faces of each of the four sides 104 comprise a light bay 108. The inside faces of each of the four sides 104 is angled outward as they extend downward, directing the light cast by the light bays 108 inward toward the recess 106 and downward toward a target area to be lighted. In alternative embodiments, the inside faces are not angled, but the light emitted from the light bays 108 is directed downward at an angle such as by orientation of the light source, reflectors or optics, or any combination thereof.

The luminaire 100 further comprises a ceiling 110 closing the top of the recess 106. Optionally, a roof 112 (see e.g. FIG. 7) can extend above the ceiling between the four sides 104 to protect the recess 106 from wind, rain, snow or other weather elements.

One or more of the four sides 104 can have heat dissipation features 114 to increase heat dissipation to the ambient environment via convection and/or radiation. In the depicted luminaire 100, the heat dissipation features 114 are comprised of a plurality of fins 116. Each fin 116 extends vertically such that the planes defined by each of its opposing faces, which comprise the majority of their surface area, are perpendicular to the ground, floor or area desired to be lighted. In this orientation, the luminaire 100 takes advantage of the ambient upward air currents caused by the rise of the warmer air due to dissipation of heat from the luminaire to the surrounding air. That is, the vertical orientation of the fin 116 causes the upward flow of air to pass across a majority of the fin surface area, increasing the convective heat transfer to the surrounding environment.

Each side 104 of the luminaire 100 comprises a rounded outer side 118 along its length. As depicted, each of the plurality of heat dissipation fins 116 extends from a base located at a point inward of the outer side 118 to a tip located at the outer side 118 and the tip comprises the same rounded configuration as the remainder of the side 104. The deeper fin 116 extends, the more heat transfer surface area that is created. It will be understood by those of ordinary skill in the art that the number and size (e.g. depth) of the fins can be varied to suit the needs of a luminaire depending on the need for lumens generated and the corresponding amount of heat generated to create those lumens. The type of light source and its sensitivity to heat will also factor into this calculation. For example, LEDs operate more efficiently and have greater longevity when operated at low temperatures. Thus, maximum cooling capabilities may be desired for a luminaire using one or more LEDs as light sources.

Figure 5:
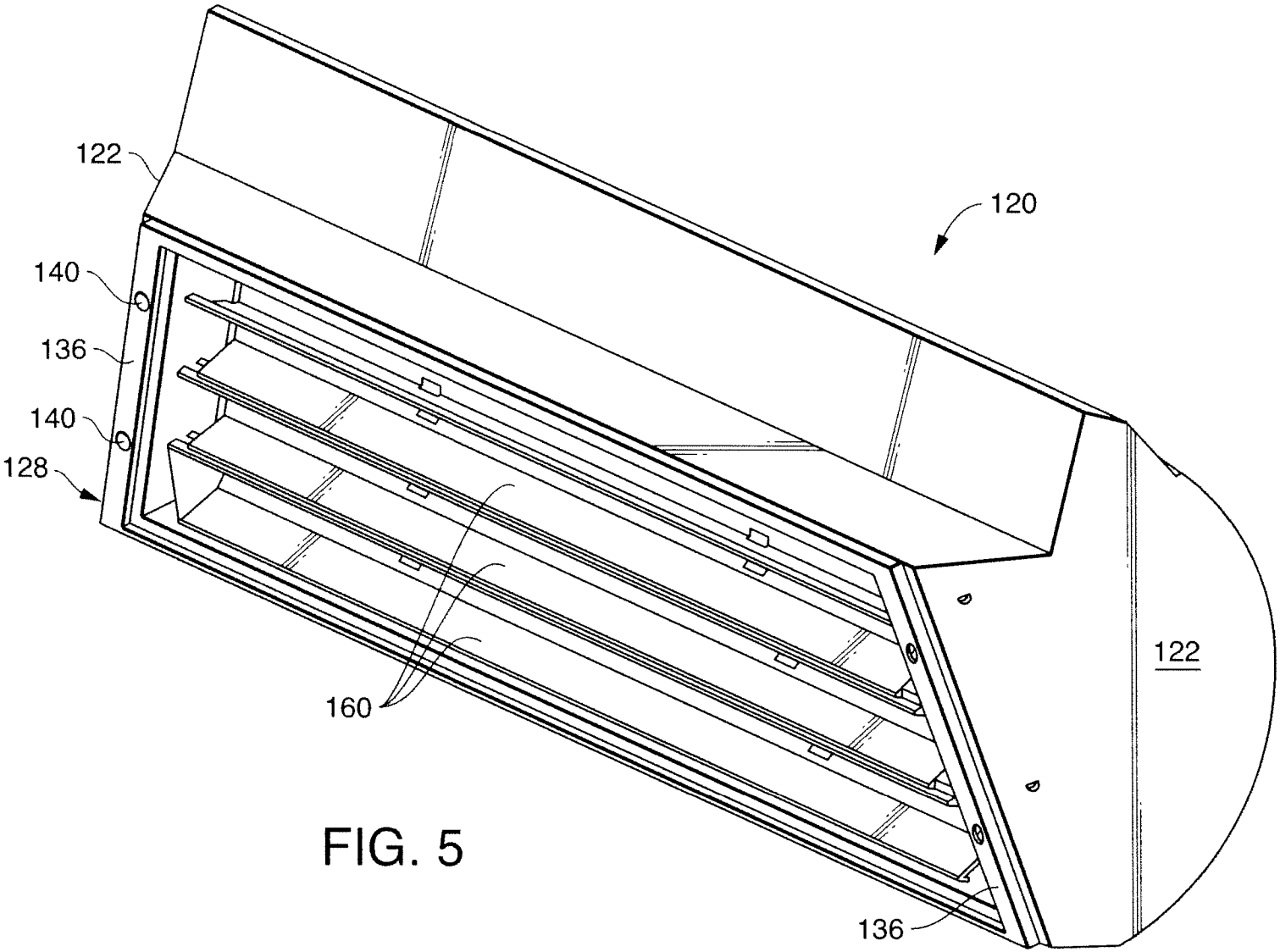
FIG. 5 depicts a perspective view of one side member of the luminaire of FIG. 1.
Figure 6:
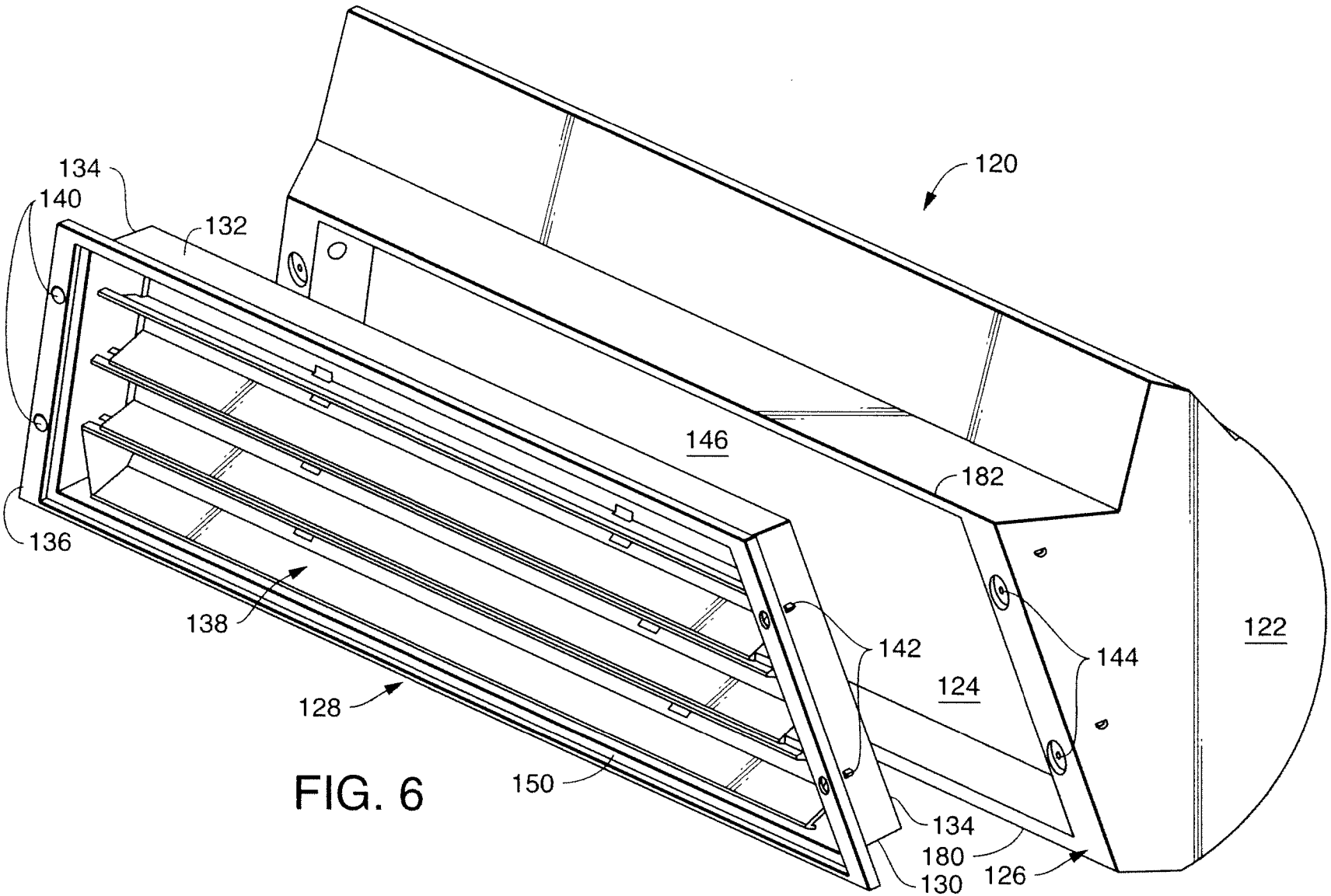
FIG. 6 depicts an exploded view of the side member of FIG. 5.

In one embodiment, the depicted luminaire 100 is comprised of four side members 120 (depicted in FIGS. 5 and 6 and in cross-section in FIGS. 7-8 and 10) each constituting one of the four sides 104 of the luminaire 100. In this embodiment, each side member 120 has opposing ends 122. The ends 122 of the depicted side members 120 are flat and angled at 45° to the length of the side member 120 such that when four side members 120 are placed end 122 to end 122, the four side members 120 constitute a rectangular (depicted as square) luminaire 100. Constructing each end 122 at a 45° angle in this manner provides the advantage of being able to create a square luminaire 100 from four identical side members and a non-square rectangular luminaire from two identical longer side members and two identical shorter members. Of course, other angles can be used to accomplish the other features of the luminaire of the present disclosure.

The side members 120 are secured one to the others at their ends 122. In one embodiment, the ends are bolted to one another through holes in their ends 122 in any known manner. Other manners of securing the ends 122 to each other, including for example intervening brackets, are also contemplated. In other embodiments, the ends 122 are not flat, but instead have projections and/or complementary indentations (not depicted) to align the side members 120 to each other properly, which provides a more aesthetic luminaire and ensures proper placement and orientation of the light sources for a proper light distribution from the luminaire.

The side members 120 can be of a cast, folded sheet metal or other construction. In one embodiment, the side members 120 are cast aluminum.

In the depicted embodiment, the side members 120 comprise a light module recess 124 in a face 126 that faces the recess 106 when assembled into the luminaire 100. The light module recess 124 accommodates a light module 128 which provides the light bay 108 of the luminaire 100. When assembled together, the side members 120 are configured so that the face 126 angles outward as it extends downward. This assists in directing light emitted from the light module in the desired direction, as will be discussed in more detail below. It also results in the face 126 of the side members 120 having a trapezoidal face, wider at the bottom and narrower at the top.

The depicted light module 128 is configured as a tray having a lower edge 130, and upper edge 132 and left and right edges 134. To maximize use of the side member face 126, the light module 128 is trapezoidal, having the lower edge 130 longer than the upper edge 132, and the left and right sides 134 angled in a trapezoidal configuration. The light module 128 comprises a flange 136 extending from the left and right sides 134 at the front thereof. The light module lower edge 130, upper edge 132 and left and right edges 134 circumscribe a light bay cavity 138 extends reward of the flange 136 to house the light bay. The flanges 136 comprise apertures 140 to receiving screws 142 or the like permitting securement of the light module 128 to the side member 120 via holes 144 in the side member face 126. In one embodiment, the backside of the light bay cavity is of substantially the same configuration as the front face 146 of the light module recess 124 in order to maximize surface contact there between, allowing maximum heat transfer from the light module to the side member 120, including the heat dissipation features 114, 116. It is contemplated that fins or other surface-area increasing features could exist on the back of the light module 128 with complementary receiving features on the side member front face 146 to increase surface area contact between the two.

The light bay cavity 138 of the light module 128 comprises a base 148 (see FIG. 8) surrounded by the lower 130, upper 132 and side 134 edges of the light module 128. The front of the light module 128 defines a recess 150 to receive a lens 152 at the front of the light module 128. A cavity 154 may be formed where the lens 152 interfaces with the light module 128 to provide for a lens gasket to seal the light bay cavity 138, preventing moisture, dirt, etc. from entering. In this configuration, the light modules 128 are self-contained light modules that can be manufactured, inventoried and/or shipped separately from the remainder of the luminaire 100 for quick and simple installation. In one embodiment, the cavity 154 can be provided with gasketing adhesive that both adheres the lens 152 to the light module tray and creates a seal between the two.

In an alternative light module configuration, the lens is secured to the flange such that the light module is placed in the light module recess and then the lens and flange screwed over the remainder of the light module against the gasket in the gasket cavity to secure the entire light module in the light module recess.

A printed circuit board ("PCB") 156 is mounted on the light bay cavity base 148 providing a plurality of LEDs 158. The LEDs 158 are aligned into three rows. While the depicted embodiment shows all LEDs 158 on a single PCB 156, other configurations are contemplated within the scope of this disclosure.

Figure 7:
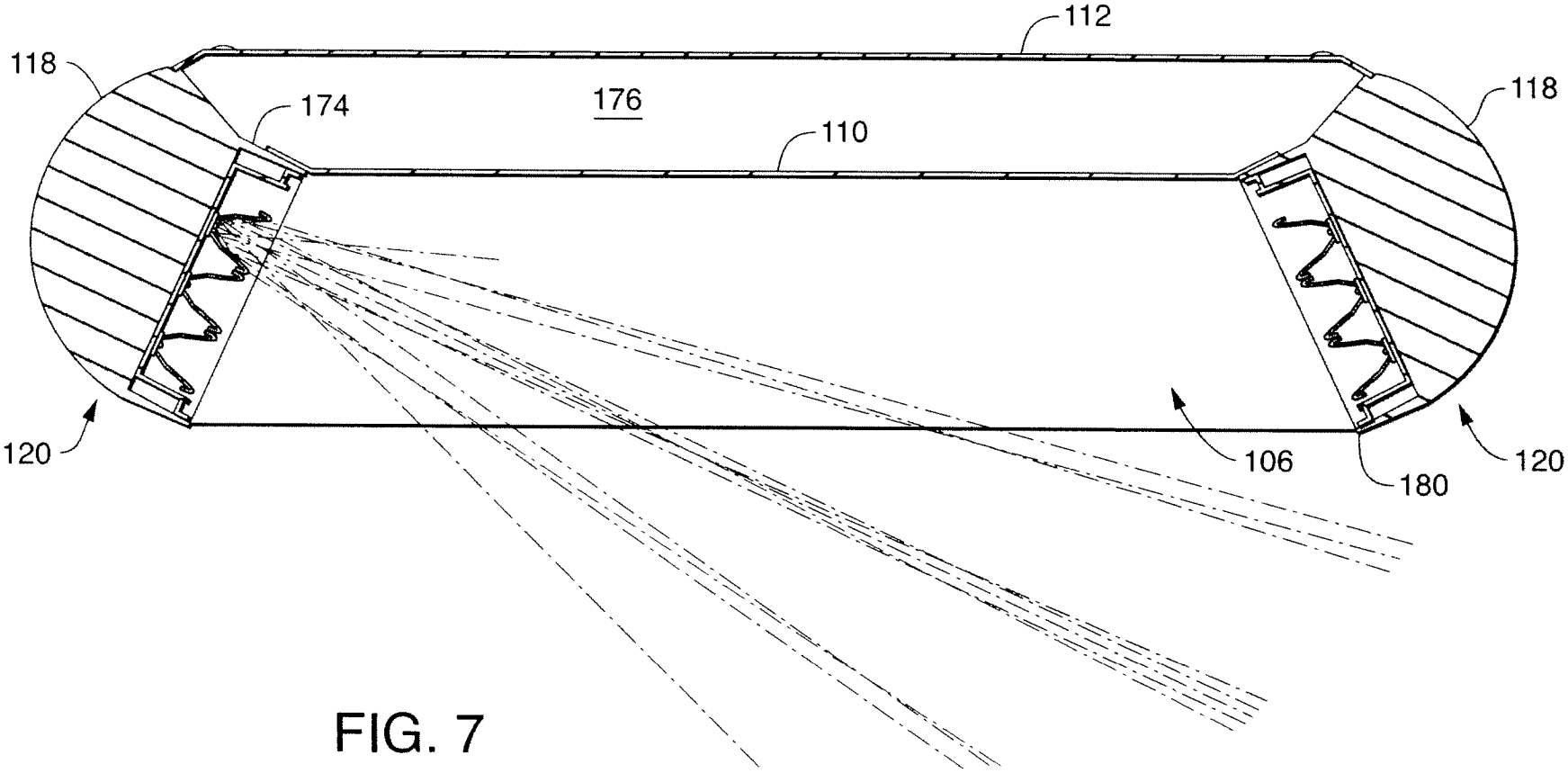
FIG. 7 depicts a cross-sectional view of the luminaire of FIG. 1 and light ray traces emanating from one light source therein.
Figure 8:
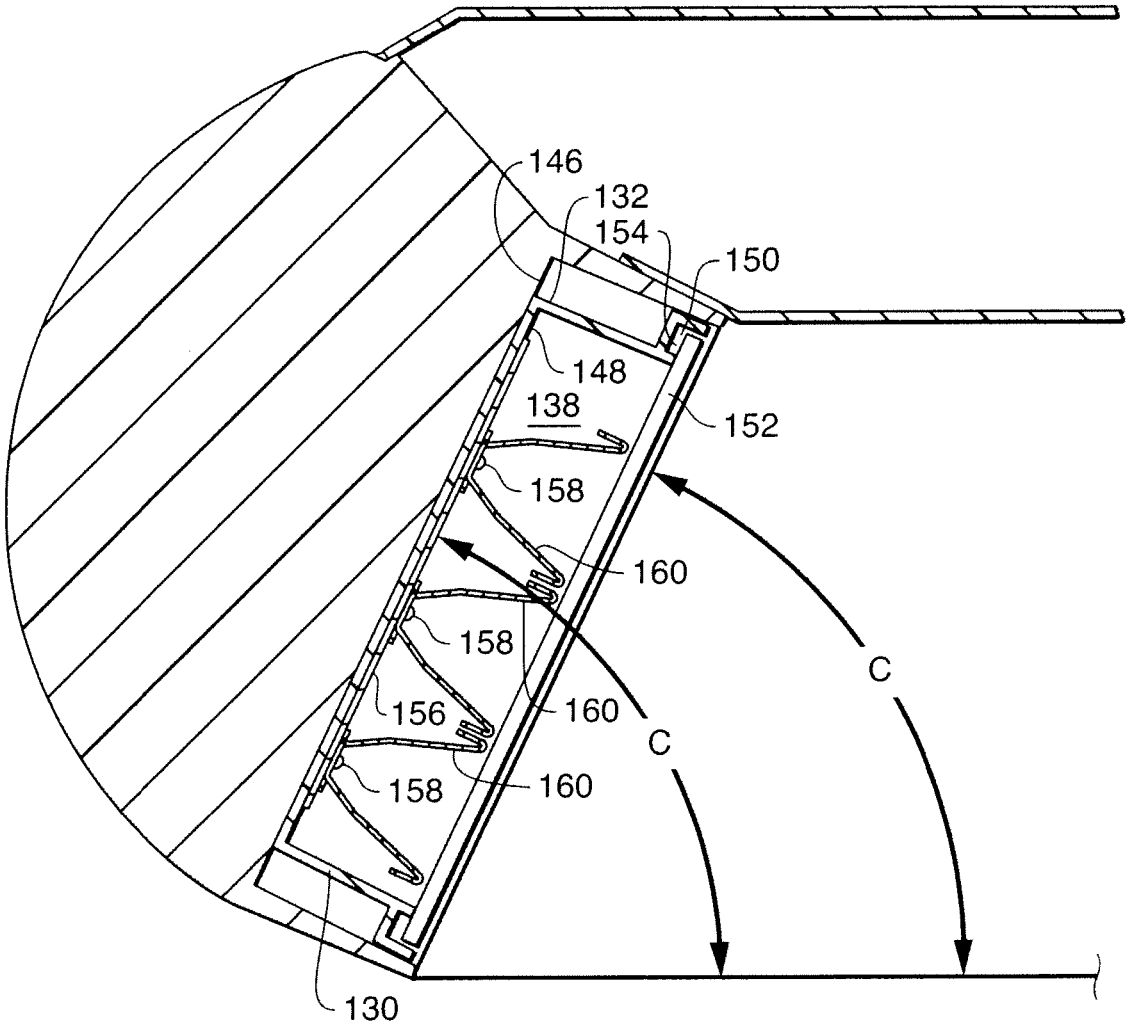
FIG. 8 depicts a portion of FIG. 7.
Figure 9:
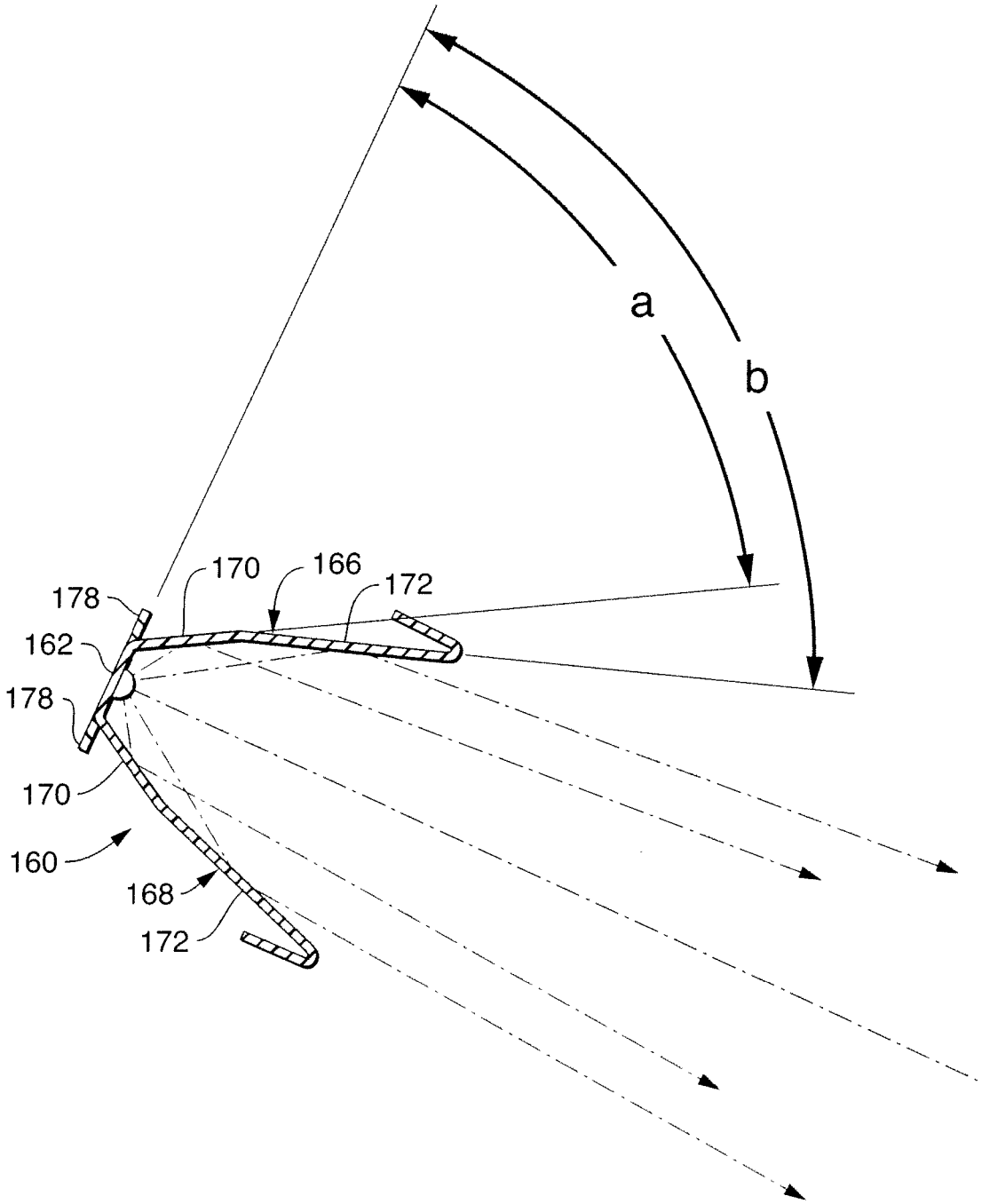
FIG. 9 depicts light rays traces emanating from a light source of the luminaire of FIG. 1.
Figure 10:
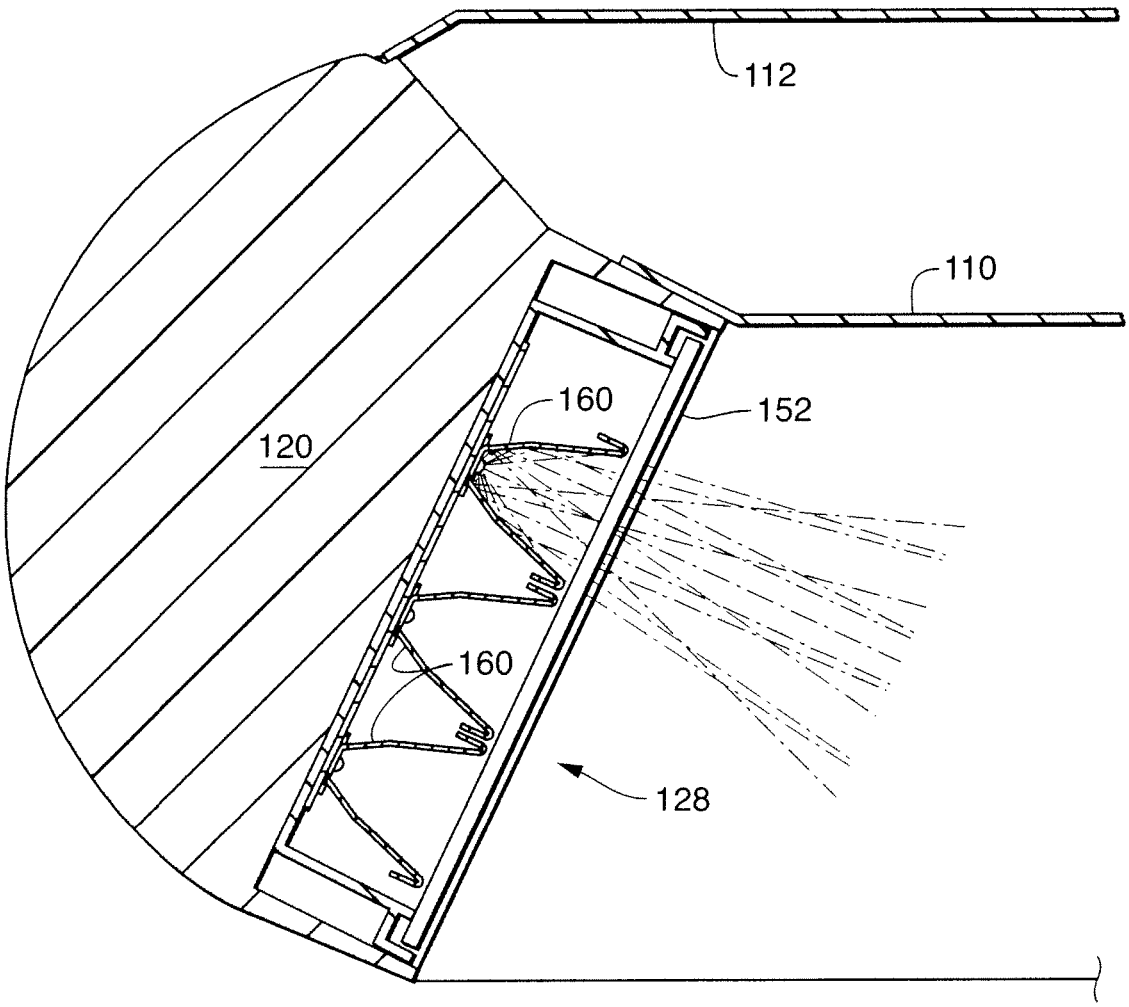
FIG. 10 depicts a portion of FIG. 7 with light rays traces emanating from a light source.
Figure 11:
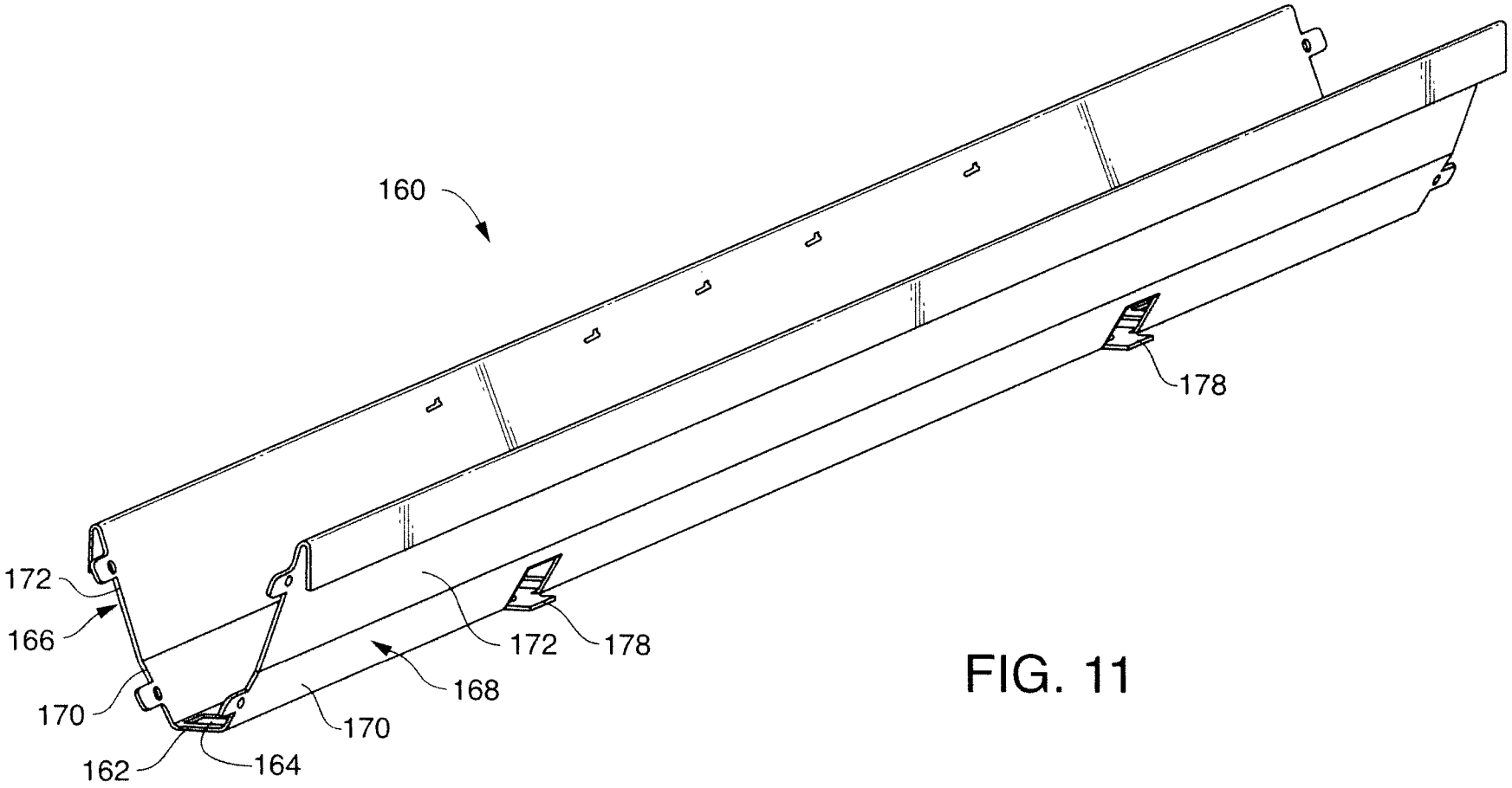
FIG. 11 depicts a perspective view of a reflector of the luminaire of FIG. 1.

The light modules 128 further comprise a reflector 160 over each row of LEDs 158 to direct the light emitted from the LEDs 158. FIG. 9 depicts a cross-sectional view of a reflector depicted in FIGS. 7-8 and FIG. 10 depicts a close-up view of the reflectors 160 in one side member 120 of FIG. 7. FIG. 11 depicts a perspective view of the reflector 160 of FIG. 9 separated from the remaining elements of the luminaire 100. In the depicted embodiment, reflectors 160 comprise a base 162 with a series of holes defining apertures 164 through which the LEDs 158 protrude when the base 162 is placed on the PCB 156. Tabs 178 may extend from the base to assist in securing the reflector 160 to the light module 128. First and second member 166, 168 extend from opposing sides of the reflector base 162. The first and second members 166, 168 each comprise a straight proximate angled portion 170 extending from the base 162 and a straight distal angled portion 172 extending from the proximate angled portion 170. The proximate and distal portions 170, 172 of the first and second member 166, 168 are configured to direct the light emitted from the LEDs 158 as desired. It is contemplated that more or fewer portions at different angles or curvatures may be used to achieve the desired light distribution. It is contemplated that optical lenses may be used in addition to, or in replacement of, reflectors 160 to achieve the desired light distribution.

As depicted in FIG. 9, the depicted reflectors 160 orient the proximate angled portions 170 of the reflectors 160 at an angle a of 60° from a plane defined by the PCB and the second angled portions 172 at an angle b of 71° from that plane. When used in conjunction with a variety of different types of LEDs (e.g. any LED providing a lambertian distribution, such as a Nichia NVSW219A) this reflector configuration collimates the light emitted from the LEDs 158 such that all, or substantially all, of the light emitted from the LEDs 158 leaves the reflector 160 substantially perpendicular to the PCB 158 as shown by the light ray traces in FIG. 9. Other manners of collimating light emitted from these or different LEDs are also contemplated.

As discussed above, the depicted light modules have a trapezoidal shape. In this configuration, the row of light sources 158 and corresponding reflector is longer at the bottom of the trapezoidal shape of the light module 128 in order to maximize the light sources 158, and thus lumen capability, available in the space allowed. Accordingly, the reflectors 160 will be of increasing length from the top row to the bottom row.

When these reflectors 160 are incorporated into the light modules 128, the lens 152 is preferably substantially parallel to the light module base 148, and therefore the PCB 156, such that the light rays exiting the reflectors 160 reach the lens 152 approximately perpendicular to the plane defined by the lens 152, as shown in FIG. 10. Directing the light rays such that they address the lens 152 approximately perpendicular to the plane it defines substantially reduces internal reflection of such light rays by the lens 152. The configuration of the light module 128 therefore substantially reduces lumen loss due to internal reflection at the lens 152. Because the light module is a factory assembled module, the reduced or eliminated internal reflection is guaranteed throughout the lifetime of the light module 128 and any luminaire comprising such a light module 128 will recognize increased efficiency as a result.

In the depicted embodiment, the lens 152 of the light module 128 is angled at an angle c of approximately 65° from horizontal as shown in FIG. 8. It is common to place a lens horizontally across the lowermost portion of a luminaire. On the luminaire disclosed herein, such a lens would extend across and between the lowermost portions of the side members. In such a configuration, the collimated light rays leaving the light module 128 would address such a horizontal lens at an angle of approximately 65°. It is believed that at such an angle of incidence, approximately 10% of the light rays would be reflected off of the lens, keeping those light rays inside the luminaire, thus cutting the lumen output by 10% and creating energy inefficiencies. The luminaire 100 does not comprise any lens other than lenses 152 of the light modules 128, through which collimated light rays pass perpendicularly, thus minimizing lumen loss due to internal reflection and maximizing energy efficiencies.

By constructing the light module 128 as a self-contained, preassembled module, the light module 128 allows assembly and/or installation of a luminaire without those elements contained in the light module 128, which are typically the most fragile elements in the luminaire. For example, the luminaire could be assembled and mounted in place, leaving installation of only the light modules 128. The light modules 128 could then be wired and screwed into place to preserve the integrity of the light module 128 and its elements. Additionally, the self-contained, preassembled character of the light module 128 allows for simple replacement if one or more elements of the light module 128 is damaged; for example, the malfunction or expiration of an LED 158. Use of the light modules 128 also permits upgrading the LEDs 158 when newer, better or otherwise different LEDs or other light sources are later developed or desired.

Returning to FIG. 7, wiring (not depicted) to provide power to the LEDs 158 can extend out of the light module 128, preferably through the upper edge 132. When installed in a side member 120, the upper edge 132 of the light module 128 resides adjacent to an upper lip 174 of the side member 120. A hole (not depicted) can be provided in the upper lip 174 allowing wiring to be extended there through and into a space 176 defined between the ceiling 110 and the roof 112 where wiring exists to provide power to each of the light modules 128 in the luminaire 100. Drivers and/or ballast (not depicted) can also be located in this space 176.

The depicted luminaire 100 is configured with four like side members 120, each having a like light module 128. As depicted in FIG. 7, the four side members 120, in conjunction with the ceiling 110, form a recess 106. The light modules 128 are located on the side members 120 facing inward toward the recess 106. As shown in FIG. 8, the front face 146 of the light module recess in the side members 120 preferably forms an angle c of approximately 65° with horizontal such that the light rays emitted from the light modules 128 are projected at approximately 65° below horizontal. Because the light modules 128 face inward toward the recess 106, it is preferred that the side members 120 be of a length sufficient to allow all light rays emitted from each light module 128 at the desired angle c of (65° in the depicted embodiment) to clear the opposing side of the luminaire. That is, the length of the side members 120 are preferably great enough such that the uppermost light rays emitted from the light modules clear the lowermost portion of the opposing side member 120, as depicted in FIG. 7. The side members in the depicted embodiment have a length of 22.8 inches along the lower edge 180 of its face and 18.3 inches along the upper edge 182 of its face with the face angled at 65° from horizontal, as previously discussed and the uppermost LED 158 located 3.9 inches above the lower edge 180 of the side member face. In this configuration, substantially all of the light rays emitted by each of the four light modules 128 clear the lower edge 180 of the opposing side member 120 and substantially all of the light emitted by the LEDs 158 escape the luminaire 100.

In the depicted configuration, the luminaire 100 provides a light distribution defined by the Illuminating Engineering Society of North America ("IESNA") as a Type V light distribution. In addition to the benefits described above, the use of light modules 128 in the luminaire 100 disclosed herein facilitates providing different light distributions by using fewer and/or one or more different light modules in the luminaire 100 as otherwise described herein. For example, while the depicted luminaire 100 provides a light distribution pattern approximating an IESNA Type V light distribution, the same luminaire could approximate a different light distribution by removing or replacing one or more of the light modules 128 with a light module emitting fewer or greater lumens, or emitting light rays in a different direction through use of different reflector configurations and/or optic lenses.

In one example, removing the light module 128 from one side member 120 would create a luminaire emitting light in three directions that would approximate an IESNA Type IV light distribution commonly referred to as a "Forward Throw" distribution. This exemplary configuration would leave three side members 120 having light modules 128 and one side member 120 without a light module 128. By placing the one side member 120 without a light module 128 in the direction of the forward throw, the light module 128 of the opposing side member 120 will cast light in the forward throw direction and the light modules 128 of the two adjacent side members 120 will cast light in the two directions transverse to the forward throw direction creating a T-like light distribution approximating an IESNA Type IV light distribution. Additional LEDs could also be added to the light module casting light in the forward throw direction to increase lumen output and fewer LEDs could be added to the light modules casting light in the transverse directions to decrease lumen output to adjust the light distribution as necessary or desirable to bring the light distribution closer to the IESNA Type IV distribution, or other desired distribution. Alternatively, the number of LEDs could remain the same, but the LEDs of the respective light modules driven differently to increase or decrease lumen output as desired.

Figure 12A:
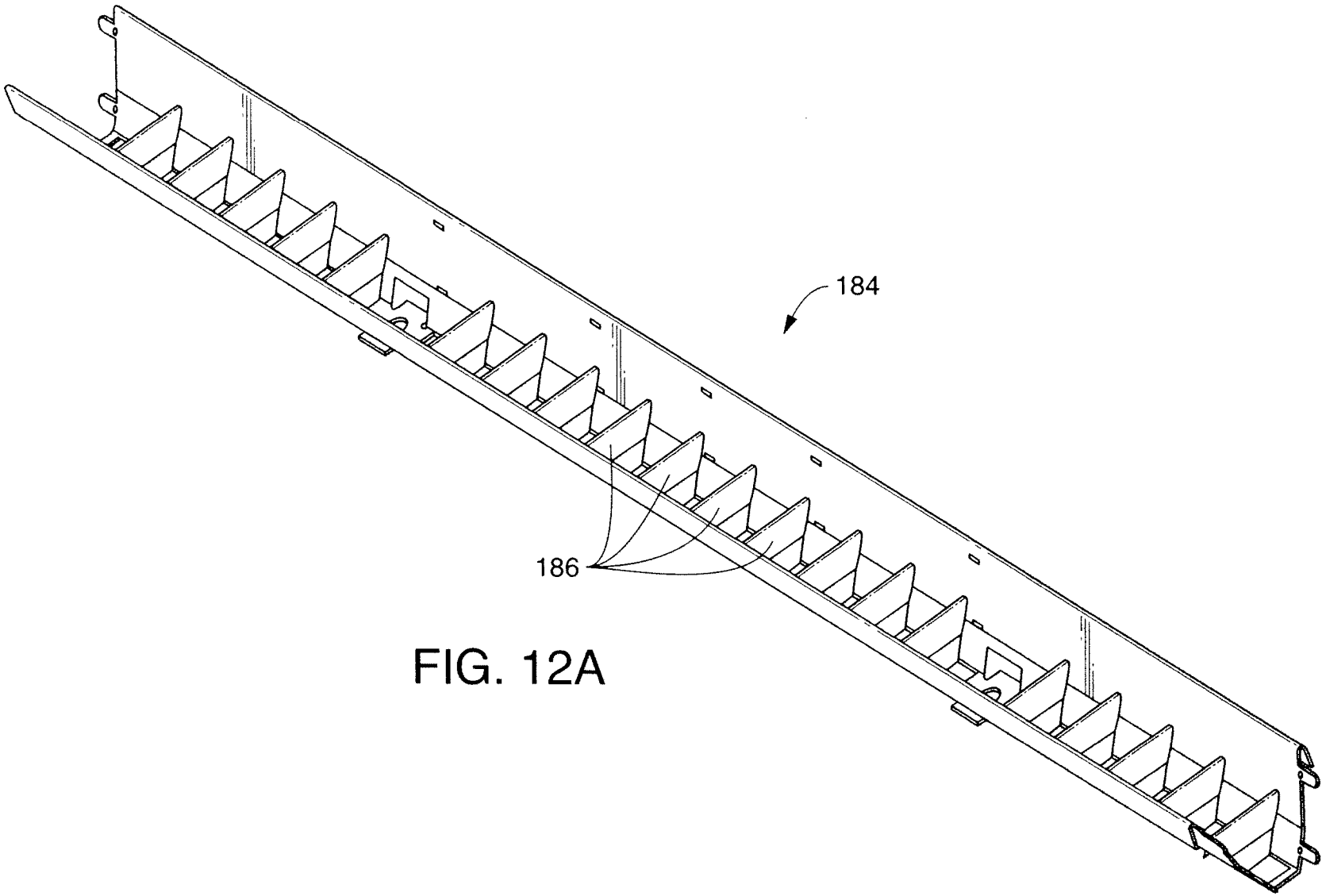
FIG. 12A depicts a perspective view of an alternative reflector to the reflector depicted in FIG. 11.
Figure 12B:
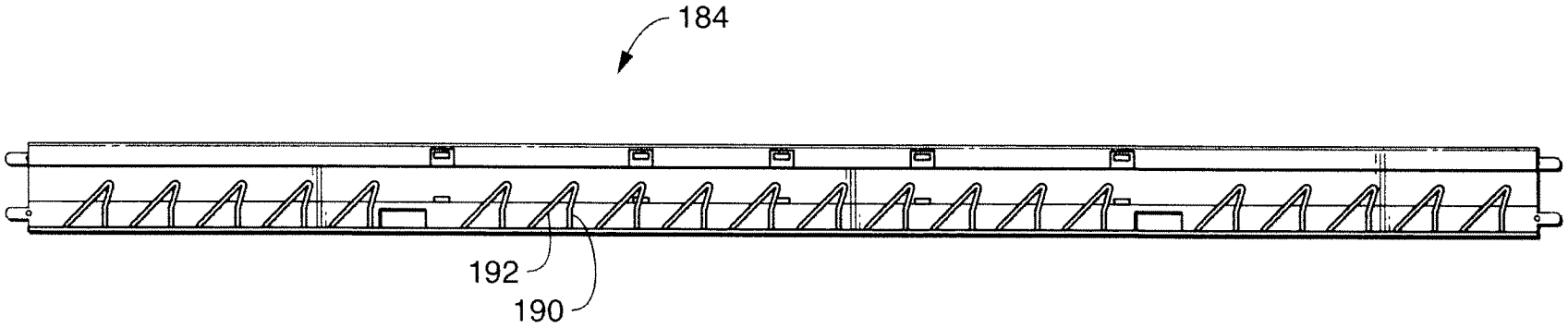
FIG. 12B depicts a longitudinal cross-sectional view of the reflector depicted in FIG. 12A.
Figure 12C:
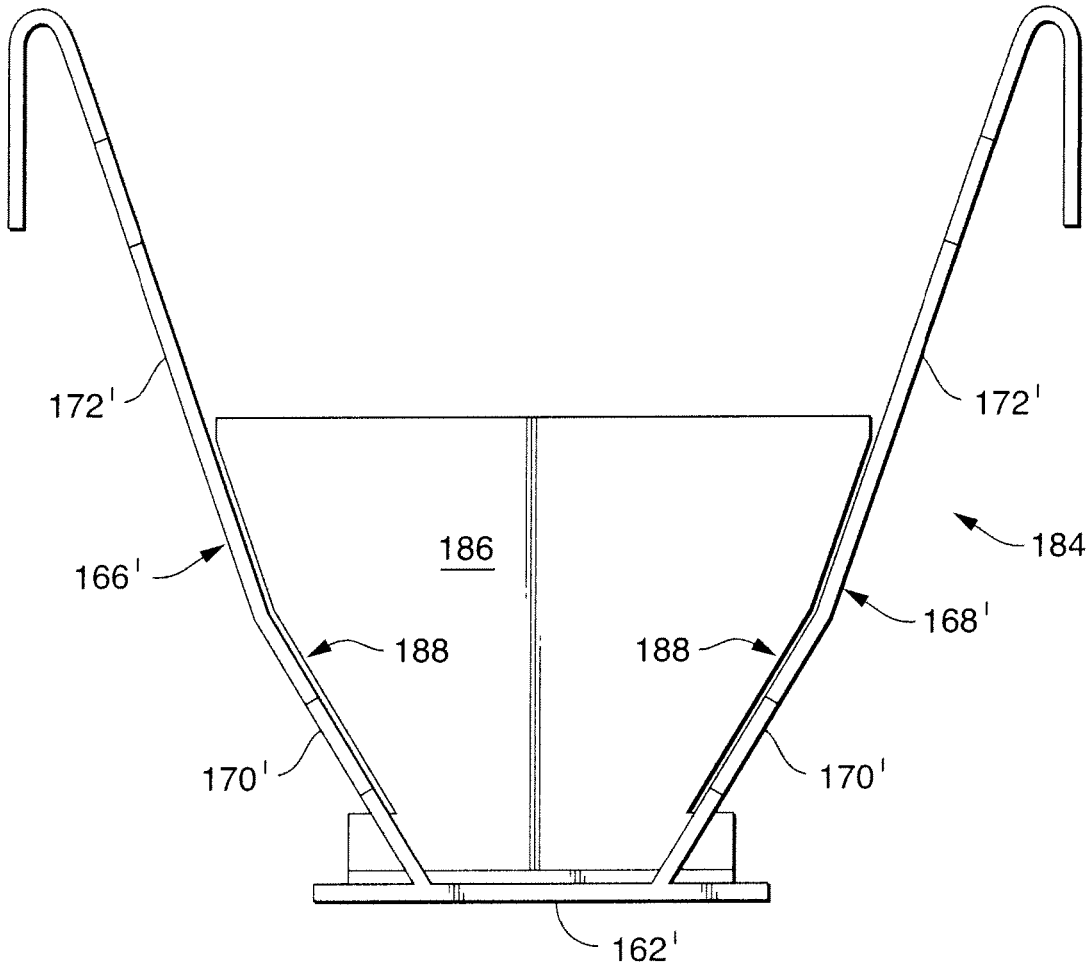
FIG. 12C depicts a lateral cross-sectional view of the reflector depicted in FIG. 12A.
Figure 12D:
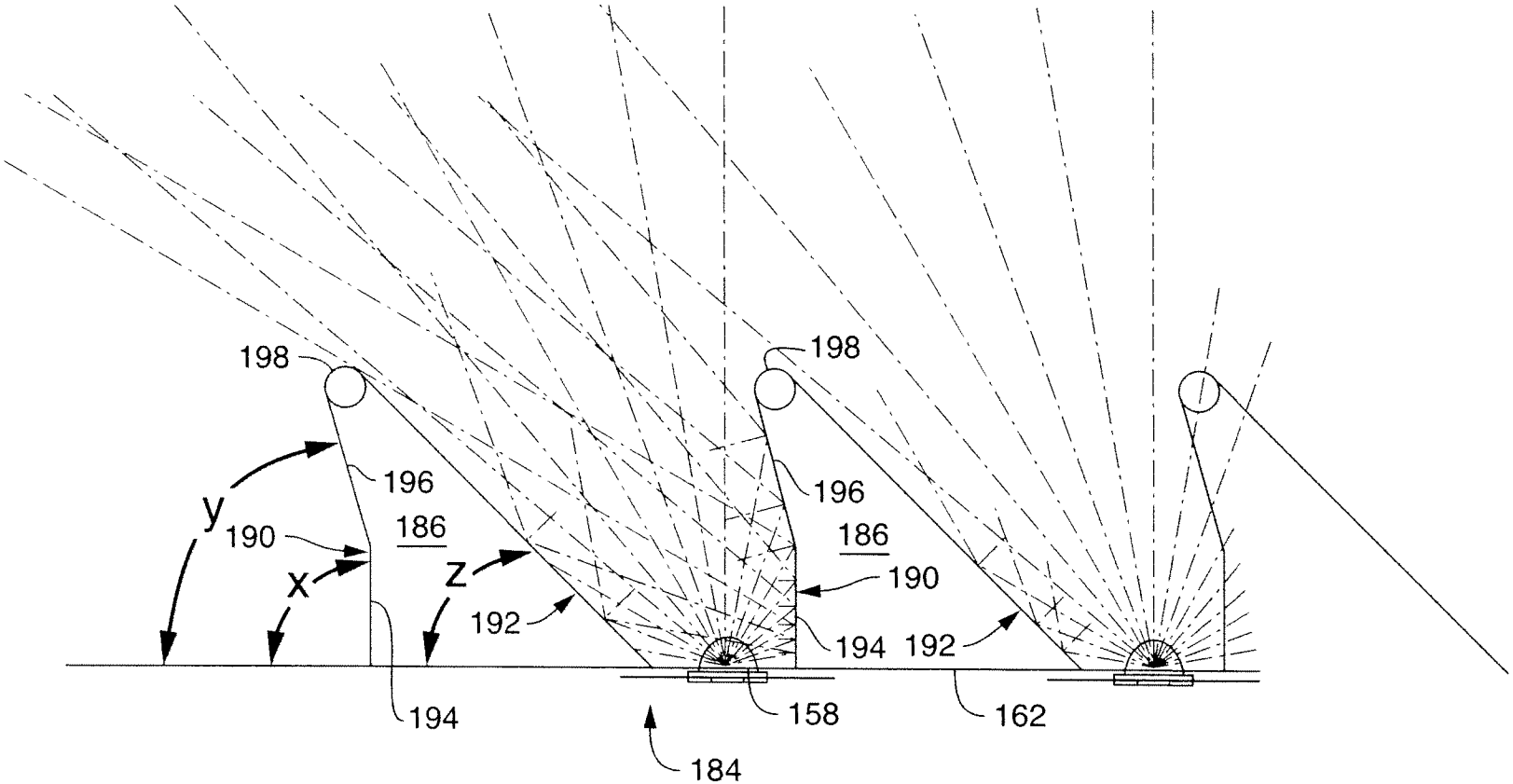
FIG. 12D depicts a longitudinal cross-sectional view of a portion of the reflector depicted in FIG. 12A with light tray traces.

In one example of a modified light module 128, the light modules of the two side members 120 casting light in the transverse directions of the above described forward throw configuration, are modified by replacing some or all of the reflectors 160 with the alternative reflector 184 depicted in FIGS. 12A-12C, which impact the light distribution as shown by FIG. 12D, which shows the alternative reflector 184 in cross-section and the light ray traces it produces. The depicted alternative reflector 184 is the same in all respects as reflector 160, with the addition of a forward throw divider 186 located between apertures 164 to redirect some of the light emitted from the LEDs 158 protruding through the apertures 164. In the depicted embodiment, the forward throw dividers 186 are all of like configuration and are constructed of formed sheet metal. More particularly, the forward throw dividers extend upward from the base 162' between the first and second members 166' and 168' angled along the sides 188 to conform to the angles of the proximate and distal angled portions 170' and 172'. Each forward throw divider 186 further has a front face 190 and a rear face 192. The front face 190 comprises a straight proximate angled portion 194 and a straight distal angled portion 196 extending from the proximate angled portion 194 to a tip 198 of the forward throw divider 186. In the depicted embodiment, the proximate angled portion 194 extends at an angle of x (preferably 90°) from the base 162' and the distal angled portion 196 extends at an angle of y (preferably 75°) from the base 162. The rear face 192 extends at an angle of z (preferably 45°) from the base 162'. The tip 198 preferably extends 0.53 inches from the base 162' and the proximate angled portion preferably extends 0.21 inches from the base 162'. In this configuration, the light is directed as depicted in FIG. 12D showing light ray traces emitted from LEDs 158 and being redirected by the front and rear faces 190, 192 of the forward throw dividers 186. The angles x and y of the proximate and distal angled portions of the front face 190 redirect a sufficient number of light rays in the forward throw direction to cast sufficient lumens in that direction and create a IESNA Type FT distribution when the alternative forward throw reflector 184 is used for all three reflectors in the light modules 128 of the side members 120 casting light in the transverse directions. That is, the forward throw dividers 186 direct some of the light rays headed in the transverse direction, toward the forward throw direction. Although the redirected light rays will address the lens 152 at an angle such that some lumens will be lost due to internal reflectance, much of the light output emitted from LEDs 158 will still address the lens 152 approximately perpendicular thereto.

The versatility of the luminaire 100 is evident when considering that an assembled luminaire 100 could be converted from producing an IESNA Type V light distribution to an IESNA Type IV light distribution by simply removing one light module 128 and replacing two others with a light module having the alternative forward throw reflectors 184. Approaching the versatility from an original construction point of view, two different luminaries can be assembled using the same parts, except for the light modules 128, for which only two different configurations need be kept in inventory.

The reflector 160, the alternative forward throw reflector 184, including the forward throw dividers 186, are preferably constructed of a sheet metal with a high reflectance such as Alanod Miro-4 Specular Aluminum. Other material are also contemplated to arrive at this configuration.

The versatility of the luminaire disclosed herein extends to nearly any light distribution desired with minor changes to the reflectors 160 and/or the addition of optic lenses. The dimensions, angles, materials, etc. described herein are indicative of the preferred embodiments disclosed herein. Many variations are contemplated to accomplish variations in performance.

Furthermore, the depicted luminaire 100 comprised of four side members 120 is only one currently preferred embodiment. Luminaires having other numbers of side members are also contemplated to accomplish a desired lumen output and light distribution. It is recognized that modifications to portions of the depicted luminaire 100, including the side members 120, would be necessary to accommodate the change in number of side members. For example, an alternative luminaire could comprise three side members configured substantially like the depicted side members 120 except that their ends 122 may need an angular adjustment to allow direct attachment of each side member end to another side member end. In a three side member configuration, the ends 122 could be angled at 60° rather than the 45° of the depicted embodiment. Alternatively, angled connectors could be inserted between the side members 120 of the depicted configuration or other configurations to provide the angle necessary to facilitate a luminaire of any number of side members desired. It is also contemplated that in addition to a luminaire of any number of side members, each of the side members could have a light module 128 of the depicted configuration or any other configuration, or no light module at all, in order to produce any light distribution desired from the luminaire as a whole.

The LEDs of this exemplary embodiment can be of any kind, color (e.g., emitting any color or white light or mixture of colors and white light as the intended lighting arrangement requires) and luminance capacity or intensity, preferably in the visible spectrum. Color selection can be made as the intended lighting arrangement requires. In accordance with the present disclosure, LEDs can comprise any semiconductor configuration and material or combination (alloy) that produce the intended array of color or colors. The LEDs can have a refractive optic built-in with the LED or placed over the LED, or no refractive optic; and can alternatively, or also, have a surrounding reflector, e.g., that re-directs low-angle and mid-angle LED light outwardly. In one suitable embodiment, the LEDs are white LEDs each comprising a gallium nitride (GaN)-based light emitting semiconductor device coupled to a coating containing one or more phosphors. The GaN-based semiconductor device can emit light in the blue and/or ultraviolet range, and excites the phosphor coating to produce longer wavelength light. The combined light output can approximate a white light output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light (or another desired color). In yet another suitable embodiment, colored LEDs are used, such are phosphide-based semiconductor devices emitting red or green light, in which case the LED assembly produces light of the corresponding color. In still yet another suitable embodiment, the LED light board may include red, green, and blue LEDs distributed on the printed circuit board in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities. Clusters of different kinds and colors of LED is also contemplated to obtain the benefits of blending their output.

Although the embodiments described herein use LEDs to generate light rays, other light sources are also contemplated. The disclosed luminaire is not limited to use of LEDs.

While certain embodiments have been described herein, it will be understood by one skilled in the art that the methods, systems, and apparatus of the present disclosure may be embodied in other specific forms without departing from the spirit thereof. For example, while aspects and embodiments herein have been described in the context of certain applications, the present disclosure is not limited to such; for example, embodiments of the present disclosure may be utilized generally for any light distribution applications.

Accordingly, the embodiments described herein, and as claimed in the attached claims, are to be considered in all respects as illustrative of the present disclosure and not restrictive.

What is claimed is:

1. An area lighting luminaire comprising:

four side members each defining an upper edge, a lower edge, an inner face and an opposing outer side, the inner faces of the four side members defining a luminaire recess and facing into the luminaire recess;

a recess defined in the inner face of at least one side member;

a light module in the recess in the inner face of the at least one side member, the light module comprising:

one or more light sources;

one or more light directing members;

a lens enclosing the light sources and directing members in the module;

the light directing members redirecting light emitted from at least one of the one or more light sources to be perpendicular to the lens;

the light module lens facing the luminaire recess; and the luminaire having no lens extending across the lower edges of the side members.

2. The luminaire of claim 1, wherein at least one light source is an LED.

3. The luminaire of claim 1, wherein one or more of the light directing members is a reflector.

4. The luminaire of claim 1, wherein one or more of the light directing members is an optic lens.

5. The luminaire of claim 1, wherein the light modules direct light toward and through the recess.

6. The luminaire of claim 1, wherein at least one of the side members comprises heat dissipation fins.

7. The luminaire of claim 1, having a ceiling extending between an upper edge of each of the side members.

8. The luminaire of claim 1, wherein at least one of the side members comprises no light module.

9. The luminaire of claim 1, where the luminaire comprises at least two light modules, which are configured to cast different light distributions different from one another.

10. The luminaire of claim 1, the light module comprising a tray and the lens is sealed to the tray keeping moisture from entering the module.

11. The luminaire of claim 1, wherein at least one of the one or more side members comprises a plurality of light modules.

12. An area lighting luminaire comprising:

four side members, each side member having an upper edge, a lower edge and an inner face and the four inner faces together defining a luminaire recess closed on one end by a ceiling;

a recess defined in the inner face of at least one of the side members;

a light module in the recess defined in the inner face of the at least one of the side members, the light module comprising:

a tray;

one or more light sources attached to the tray;

one or more light reflectors or optic lenses associated with one or more of the light sources;

a lens enclosing and sealing the light sources and the one or more light reflectors or optic lenses in the module and redirecting light emitted from at least one of the one or more light sources to be perpendicular to the lens the luminaire having no lens extending across the lower edges of the side members; and the four side member lower edges defining a plane forming an angle with each light module lens.

13. The luminaire of claim 12, wherein at least one light source is an LED.

14. The luminaire of claim 12, wherein the light module is in surface contact with the side member to conduct heat away from the light module.

15. The luminaire of claim 12, wherein at least one of the side members comprises heat dissipation fins.

16. The luminaire of claim 12, wherein the recess defined by the four side members is closed on one end by the ceiling extending between an upper edge of each of the side members.

17. The luminaire of claim 12, wherein at least one of the side members comprises no light module.

18. The luminaire of claim 12, where at least two of the light modules are configured to cast different light distributions.

19. The luminaire of claim 12, the light module comprising a seal between the tray and the lens to seal to the tray keeping moisture from entering the module.

20. The luminaire of claim 12, wherein at least one of the light module is removable from an associated side member.

21. An area lighting luminaire comprising:

a first side member, a second side member, a third side member and a fourth side member, each side member having an upper edge, a lower edge and an inner face and the four inner faces together defining a luminaire recess closed on one end by a ceiling;

a first light module associated with the first side member, a second light module associated with the second side member and a third light module associated with the third side member, each of the light modules comprising:

a tray;

one or more light sources attached to the tray;

one or more light reflectors or optic lenses associated with one or more of the light sources; and a lens enclosing and sealing the light sources and the one or more light reflectors or optic lenses in the module;

wherein no light module is associated with the fourth side member and no lens extending across the lower edges of the four side members.

22. The luminaire of claim 19, wherein the luminaire produces a light distribution approximating an IESNA Type IV light distribution.

* * * * *